United States Patent [19]

Terlesky et al.

[11] 4,041,722

[45] Aug. 16, 1977

[54] IMPACT RESISTANT TANK FOR CRYOGENIC FLUIDS

[75] Inventors: John Terlesky, New Brighton; Hugh Emil Muller; John C. Murphy, both of Pittsburgh; Harold F. Honath, Coraopolis, all of Pa.

[73] Assignee: Pittsburgh-Des Moines Steel Company, Pittsburgh, Pa.

[21] Appl. No.: 617,109

[22] Filed: Sept. 26, 1975

[51] Int. Cl.[2] ..... F17C 3/06

[52] U.S. Cl. ..... 62/45; 52/246; 52/265; 52/268; 52/294; 62/260; 165/45; 220/9 LG

[58] Field of Search ..... 62/45, 260, 55; 165/45; 220/9 LG, 18, 10, 85 F, 86 R; 52/246, 264, 265, 268, 294; 61/.5; 141/286, 374

[56] References Cited

U.S. PATENT DOCUMENTS

| | | | |
|---|---|---|---|
| 2,777,295 | 1/1957 | Bliss et al. | 62/45 |
| 3,047,184 | 7/1962 | van Bergen et al. | 220/9 LG |
| 3,092,933 | 6/1963 | Closner et al. | 62/45 X |
| 3,246,479 | 4/1966 | Kelley | 62/45 |
| 3,352,443 | 11/1967 | Sattelberg et al. | 220/18 X |
| 3,627,164 | 12/1971 | Wilson | 220/10 |
| 3,707,850 | 1/1973 | Connell et al. | 62/45 |
| 3,852,973 | 12/1974 | Marothy | 62/45 |
| 3,938,347 | 2/1976 | Riedel et al. | 62/55 |

FOREIGN PATENT DOCUMENTS

| | | | |
|---|---|---|---|
| 1,122,562 | 1/1962 | Germany | 62/55 |

*Primary Examiner*—Ronald C. Capossela
*Attorney, Agent, or Firm*—Shoemaker and Mattare, Ltd.

[57] ABSTRACT

An impact resistant tank for storing cryogenic fluids, includes an inner metal tank having a metal side wall and a metal bottom and a concrete outer wall around the inner metal wall and having reinforcement therein to resist impact loads thereon, and to serve as a secondary containment for the cryogenic fluid.

42 Claims, 29 Drawing Figures

19
19
18
17
11
12
13
20
148
83
21
82
76
74
87
75
10
56
89
88
86

IMPACT RESISTANT TANK FOR CRYOGENIC FLUIDS

BACKGROUND OF THE INVENTION

This invention relates generally to tanks for storing cryogenic fluids, and in particular to such a tank which includes means for resisting impact loads thereon and to serve as a secondary liquid containment for the cryogenic fluid.

There are many types of tanks known in the prior art for storing cryogenic fluids, and such tanks include both those comprising metal walls and those having concrete walls. Some prior art tanks include both metal and concrete walls. However, there is no cryogenic tank known to applicants which comprises both a metal inner tank for storing cryogenic fluid and a reinforced concrete outer tank or wall having means for resisting impact loads thereon to protect the inner tank and having seal means associated therewith to serve as a secondary containment for the cryogenic fluid.

Recently there has been increasing concern for providing some means in association with cryogenic storage tanks for protecting the tanks against impact loads thereon and to provide an effective liquid containment even in the event of rupture of the inner tank. For example, such tanks are becoming more common in urban areas, and the danger of a catastrophic explosion is great in such heavily populated areas in the event a large spill or leak of the cryogenic fluid occurs. For example, an explosion in the vicinity of the tank or a nearby crash of an airliner or the like could result in rupture of the wall of the tank, with the result that large amounts of the cryogenic fluid leak into the surrounding area, creating an extremely dangerous situation which could have disastrous results if the leaked cryogenic fluid should be ignited.

Insofar as is known to applicants, there are no tanks in the prior art capable of both maintaining an effective seal for the cryogenic fluids and that the same time providing an impact resisting means to withstand explosions or impact loads thereon. Thus, there is an urgent need for a storage tank for cryogenic fluids which includes means for both maintaining an efficient confinement for the cryogenic fluid and also for resisting impact loads thereon.

OBJECTS OF THE INVENTION

Accordingly, it is an object of this invention to provide a tank for storing cryogenic fluids, wherein the tank includes means for both maintaining an effective confinement for the cryogenic fluid and also for resisting impact loads on the tank to thus maintain the integrity of the confinement for the cryogenic fluid.

Another object of the invention is to provide a tank for cryogenic fluids having a novel gas vent associated therewith for venting large volumes of gas from the tank under emergency conditions.

A further object of the invention is to provide a tank for cryogenic fluids having means associated therewith for introducing the cryogenic fluid into the tank in a way to minimize the possibility of product rollover.

A still further object of the invention is to provide a bottom structure for a tank for cryogenic fluids having means for efficiently and effectively insulating the contents of the tank from ambient conditions and for also resisting impact loads on the bottom to thus maintain the integrity of the fluid confinement.

A still further object of the invention is to provide a tank for cryogenic fluids wherein the tank includes a concrete outer wall and wherein unique means are provided for attaching the roof of the tank to the concrete outer wall to resist both lateral and vertical loads thereon.

An even further object of the invention is to provide a tank for cryogenic fluids wherein the tank includes a concrete outer wall for resisting impact loads and wherein a vapor barrier is on the inner surface of the concrete wall for minimizing ingress of water vapor and the like during normal service, and for minimizing egress of gas.

A still further object of the invention is to provide a tank for cryogenic fluid wherein the tank includes a concrete outer wall having means for resisting impact loads thereon and wherein seal means is provided in association with the concrete wall for containing liquid in the event the inner tank leaks.

Yet another object of the invention is to provide a tank for storing cryogenic fluid wherein the tank includes a reinforced concrete outer wall for resisting impact loads, and wherein the concrete outer wall is poststressed in predetermined arc segments thereof to enable the concrete wall to better withstand any impact loads thereon, and also to better withstand the effects of cryogenic temperatures thereon.

DETAILED DESCRIPTION OF THE PREFERRED EMBODIMENTS

Figure 1:
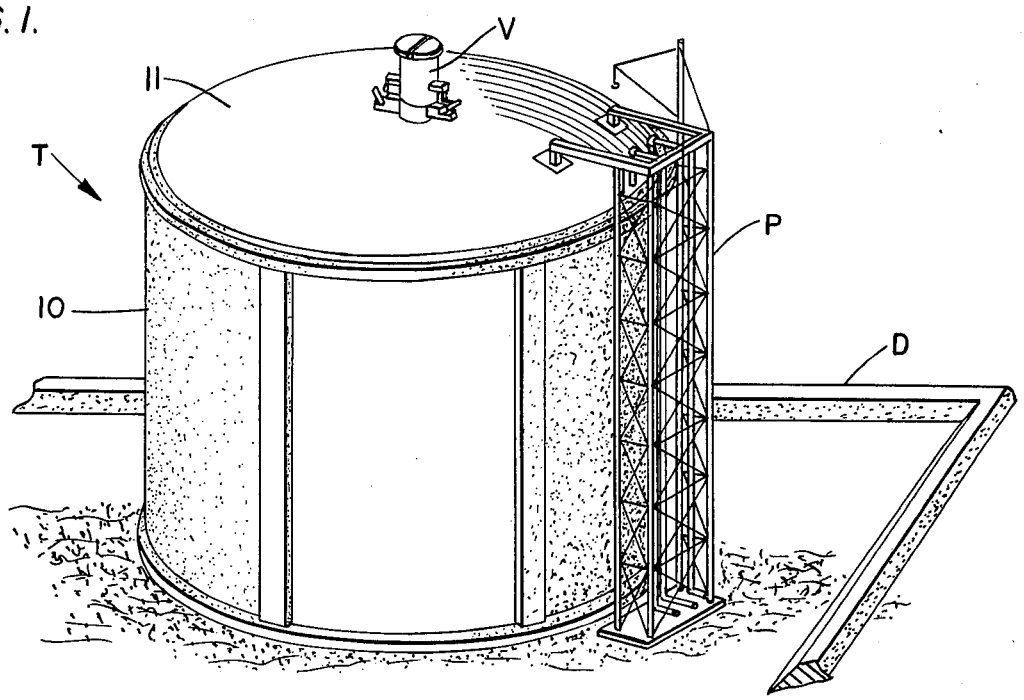
FIG. 1 is a top perspective view of a first form of tank in accordance with the invention, showing the pipe support tower adjacent thereto.
Figure 2:
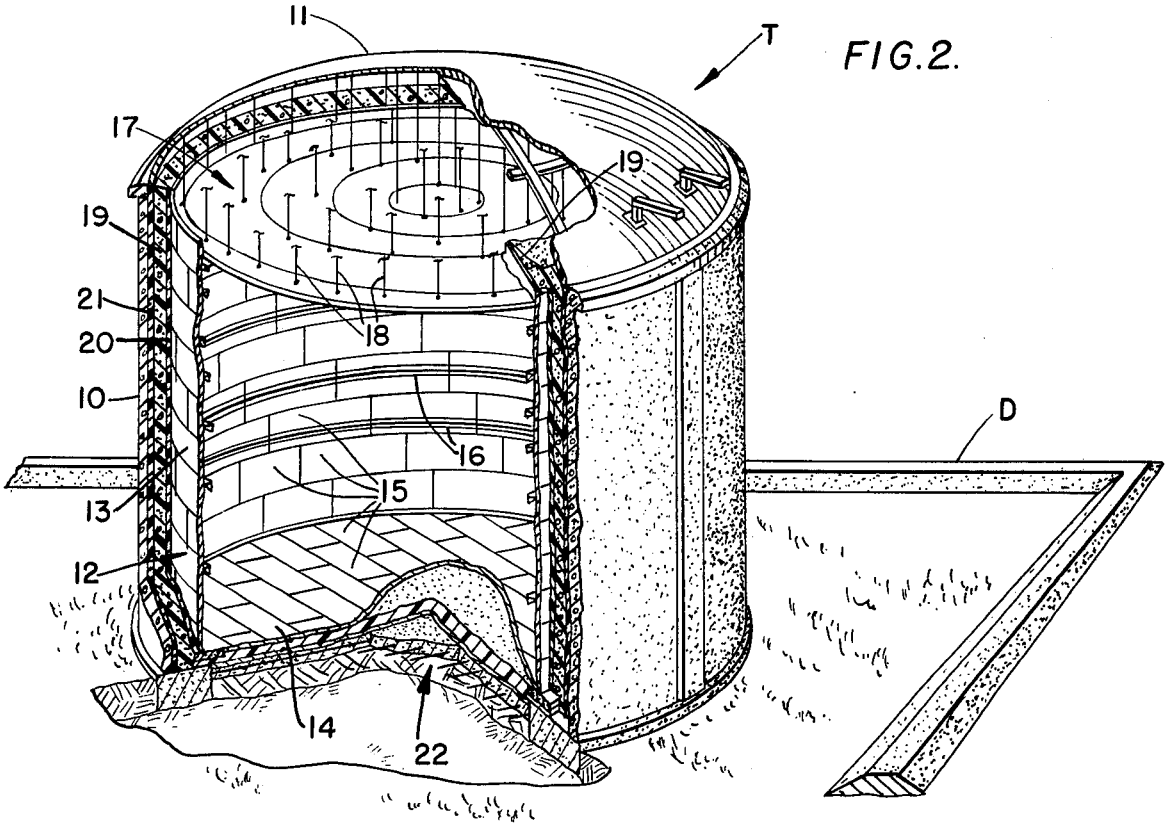
FIG. 2 is a perspective view similar to FIG. 1 with portions thereof broken away, showing the basic construction of the tank of FIG. 1 and illustrating a liquid retaining dike around the tank.

In the drawings, wherein like reference numerals indicate like parts throughout the several views, a first form of tank T includes a reinforced concrete outer wall 10 having a domed steel roof 11 supported thereon. An inner tank 12 is provided in spaced relationship inwardly of the concrete wall or tank 10 and includes a cylindrical side wall 13 of a suitable cryogenic metal, such as 9% nickel steel quenched and tempered, or the like, and a bottom 14 of like material. The bottom and side wall of the inner tank are comprised of a plurality of welded together or otherwise suitably secured together steel plates 15, and the side wall 13 is reinforced by annular reinforcing rings 16 of suitable and conventional configuration. An insulation deck 17 is suspended from the outer steel roof 11 by a plurality of hangers 18 in a conventional and well-known manner, as exemplified, for example, in U.S. Pat. No. 3,538,661. Suitable insulation 19, such as perlite or the like, is provided in the annular space between the side wall 13 of inner tank 12 and the surrounding reinforced concrete wall 10 and the insulation also covers the insulation deck 17.

A compaction control system is also provided in the annular space between the inner and outer tank walls for controlling compaction of the perlite insulation 19, and the compaction control system comprises an inner blanket 20 and outer blanket 21 of glass fiber insulation, as more fully described in U.S. Pat. No. 3,481,504.

The bottom of the tank is also suitably reinforced and insulated at 22, and an emergency vent V is provided in the roof 11 for venting large volumes of gas vapor from within the tank under emergency conditions.

A suitable freestanding pipe tower P is positioned adjacent the tank T for supporting the required piping for filling and emptying the tank and the like, and a dike D surrounds the tank for containing any liquid natural gas leaking from the tank, particularly in the event of a major rupture thereof.

In addition to the perlite insulation 19 in the annular space between the inner and outer tank walls and the double glass fiber blankets 20 and 21, a vapor barrier 23 is spray applied or otherwise suitably applied to the inner surface of the concrete wall 10. The vapor barrier is preferably about 30–60 mils thick and comprises a suitable butyl elastomer.

Figure 10:
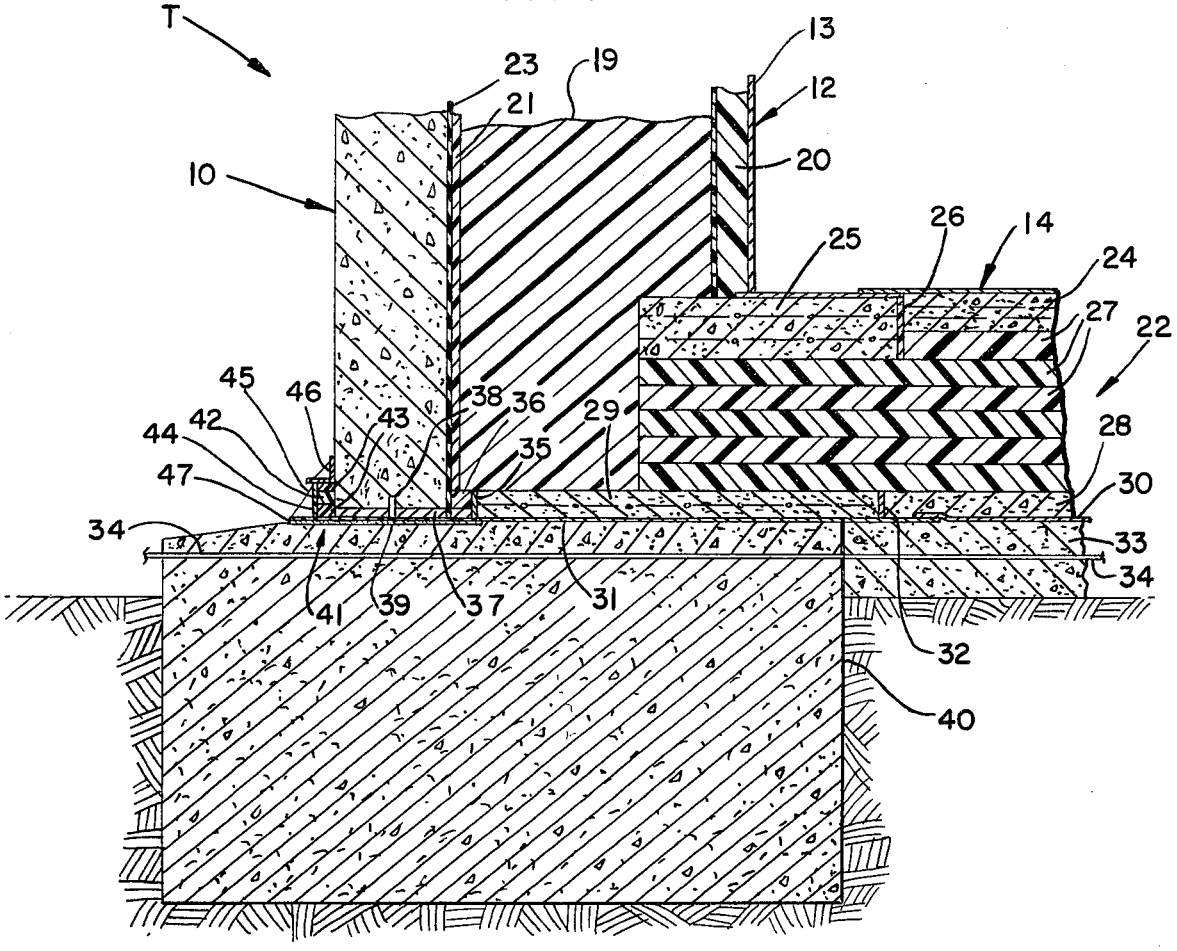
FIG. 10 is a greatly enlarged, fragmentary view in section of a portion of the inner and outer tank walls and tank bottom of a first form of tank according to the invention.
Figure 11:
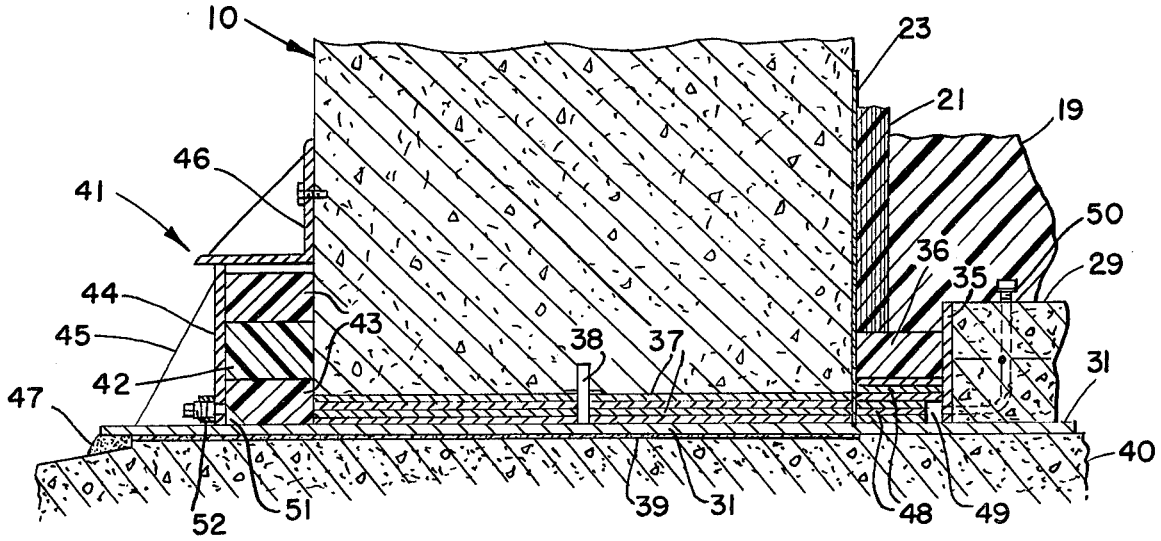
FIG. 11 is an even further enlarged fragmentary view in section of a portion of the outer concrete wall and the seal means and support therefor for the first form of the invention.
Figure 12:
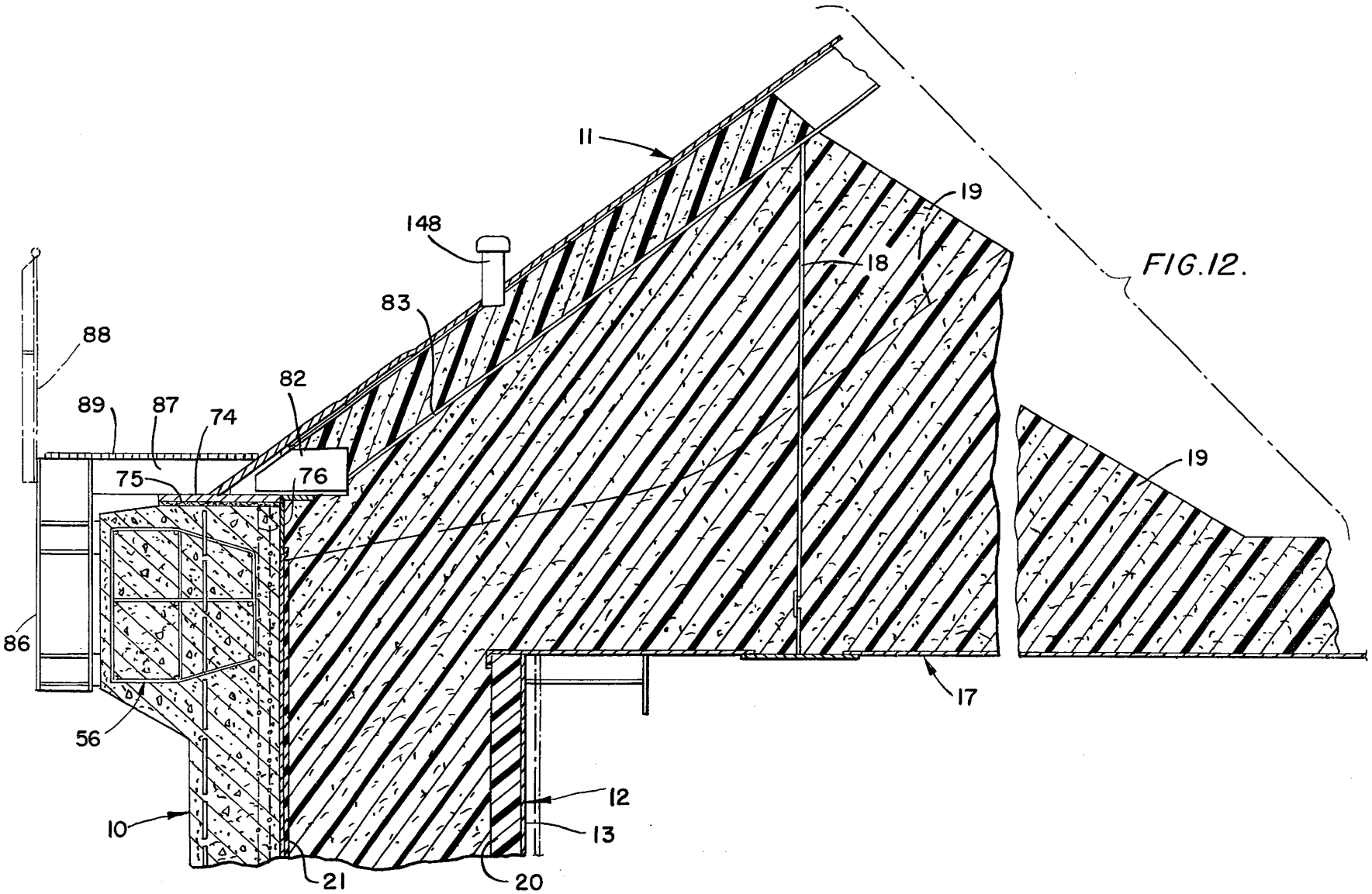
FIG. 12 is a somewhat schematic, fragmentary view in section of an upper portion of the tank showing the arrangement or position of insulation as installed therein in full lines and the disposition or arrangement of the insulation after cooldown in phantom lines.
Figure 13:
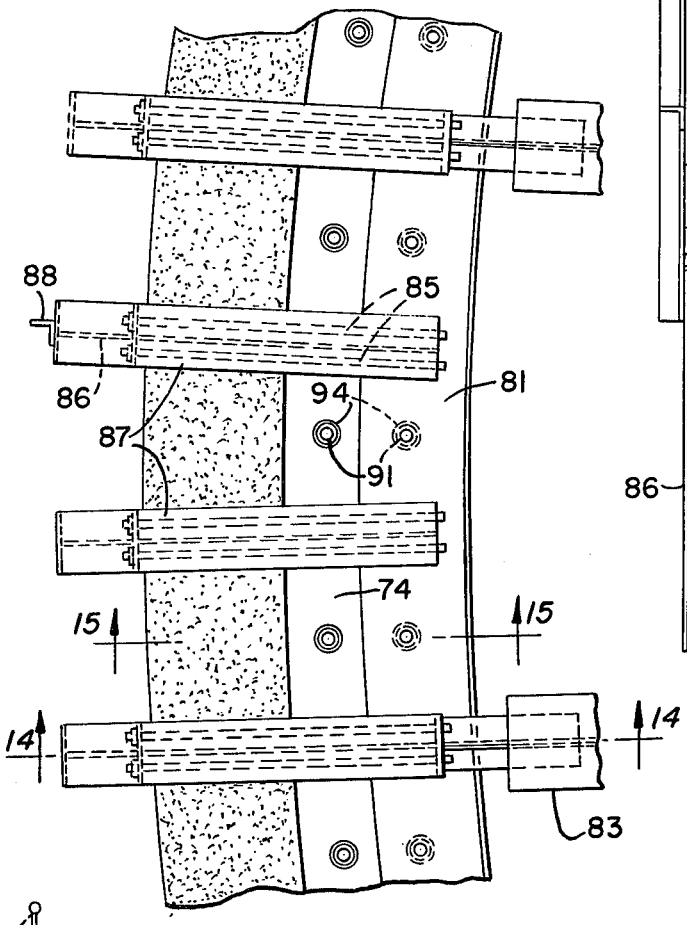
FIG. 13 is a enlarged, fragmentary, plan view of an upper portion of the side wall of the tank of FIG. 1, with the roof removed, showing the arrangement of thrust yokes, roof rafters and anchor bolts.
Figure 14:
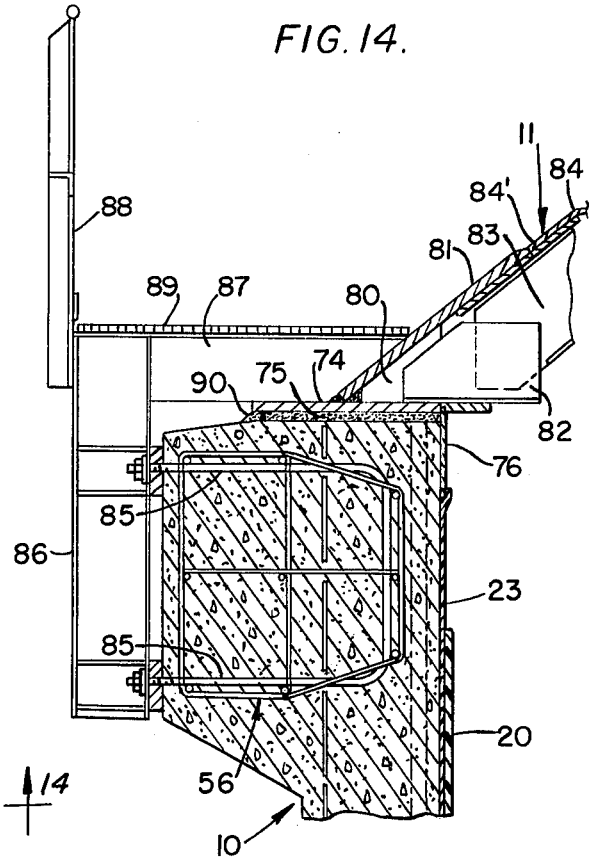
FIG. 14 is a enlarged, fragmentary view in section taken along line 14—14 of FIG. 13.
Figure 15:
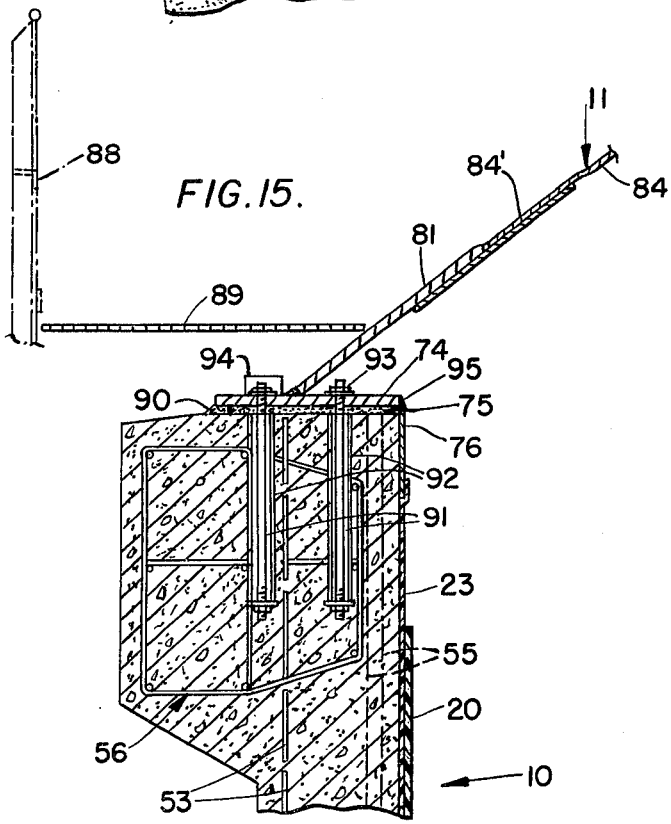
FIG. 15 is a view similar to FIG. 14 taken along line 15—15 of FIG. 13, and showing the roof and a platform or walkway in position.
Figure 16:
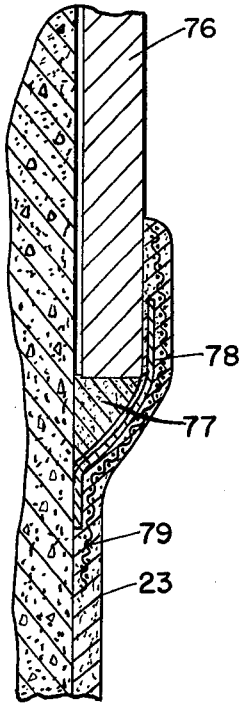
FIG. 16 is a greatly enlarged, fragmentary view in section of a portion of the inner surface of the concrete wall adjacent the upper edge thereof, showing the arrangement of sealing means therewith.

The wall-to-bottom construction and the reinforced and insulated tank bottom are best seen in FIGS. 10 and 11. The plates 15 comprising the side wall 13 and bottom 14 of the inner tank are preferably made of a suitable material such as quenched and tempered 9% nickel steel alloy, and a slab 24 of wire mesh reinforced concrete underlays the steel inner tank bottom 14. An annular ring of somewhat thicker reinforced concrete 25 extends under the side wall 12 immediately peripherally outwardly of the slab 24, and a ring 26 of compressed glass fiber or the like is disposed between the slab 24 and ring 25. A shock absorbing insulation layer comprising a plurality of layers 27 of a suitable insulation such as foamed glass block are disposed in underlying relationship to both the slab 24 and concrete ring 25, and the blocks 27 of foamed glass are supported in turn on an underlying slab 28 of lean concrete peripherally surrounded by an annular ring or layer 29 of wire mesh reinforced concrete. The slab 28 of concrete is supported on an outer tank bottom 30 of quenched and tempered 9% nickel steel alloy, and an annular sketch plate 31 of similar material is suitably welded or otherwise affixed to the outer periphery of outer bottom wall 30 of the tank, and extends outwardly beneath the ring 29 of reinforced concrete and beneath the outer reinforced concrete wall 10. A ring 32 is positioned between the bottom slab 28 and the surrounding ring 29 of concrete to serve as a form during construction. The outer tank bottom 30 is supported on a layer 33 of sand, which serves as a bed for heating means 34, preferably of a conventional electrical type, and also serves to prevent upward migration of moisture and the like from the subadjacent earth. The layer of sand is a preferred construction for some installations, such as ring wall foundation, but other suitable construction could be used.

An upstanding annular ring 35 of a suitable material, such as steel or the like, is provided on top of the sketch plate 31 spaced radially inwardly of the concrete wall 10, and a suitable resilient sealant 36 is placed in this space after poststressing of the concrete wall 10.

A layer 37 of a suitable resilient material, comprised of multiple layers of sheet gasket type material, such as compressed asbestos, is sandwiched or positioned between the bottom edge of concrete side wall 10 and the top surface of the outer tank bottom sketch plate 31, and the layer 37 is substantially coextensive in width with the concrete wall 10.

A retaining pin 38 is imbedded in the concrete wall 10 during construction of the tank, and the resilient material 37 is retained in place thereby.

An anti-friction underlayment 39 of a suitable material is disposed beneath the sketch plate 31 in the area radially outwardly of upstanding wall 35 and beneath the outer concrete wall 10 to enable the inner tank bottom to slip relative to the outer concrete wall 10 due to thermal effects.

A large ringwall foundation or footer 40 is positioned beneath the inner and outer tank walls for supporting the same. A seal 41 is provided at the bottom edge of concrete wall 10 to contain LNG in the event the inner tank is ruptured. The seal 41 comprises a center layer 42 of a suitable material, such as flexible foam fill, and top and bottom layers 43 of a suitable material, such as a non-hardening butyl/polybutylene. The seal 41 is retained in place by an upstanding, annular, outer wall 44 suitably reinforced with gussets 45 or the like welded to the wall and to the bottom sketch plate 31, and a top angle-shaped weather protector and seal keeper 46 bolted or otherwise suitably pinned to the concrete wall 10. A suitable sealant, such as polybutylene or the like 47 is also provided around and immediately beneath the extreme outer periphery edge of outer tank bottom wall 31.

The space below the elastomer sealant 36, which is preferably a polysulfide or the like, is filled with a board form fill material 48 which extends from the annular upstanding wall 35 to the vapor barrier 23 on the inner surface of concrete wall 10. The board form fill material 48 is cut away, defining a continuous annular space 49, which extends completely around the tank, and a pressure fitting 50 is in communication therewith for testing the effectiveness of the seal provided by the elastomer sealant 36. Similarly, a portion of the bottom layer 43 of flexible foam fill material at the outer bottom edge of concrete wall 10 is cut away, defining a continuous annular space 51, and a pressure fitting 52 is in communication therewith for testing the effectiveness of the outer seal 41.

The elastomer sealant 36 enables relative movement between the concrete wall and the upstanding inner wall 35 upon thermal expansion and contraction of the outer tank bottom, which for some tanks may result in approximately a ⅜ inch change in the space filled by the elastomer sealant 36. Similarly, the non-hardening seal 42 at the outer surface of concrete wall 10 enables relative movement to occur between the bottom plate and the concrete wall and still retain a effective seal. For example, upon rupture of the inner tank or a leak occurring for some other reason, the distance between outer seal retaining wall or flange 44 and the adjacent outer surface of concrete wall 10 may change approximately 1 inch, for example, for some tanks, due to thermal effects.

The space between the inner and outer walls and bounded by the glass fiber blankets 20 and 21 is purged with a gas, such as methane or nitrogen and the like, and the vapor barrier 23 and resilient sealant 36 serve to contain the purge gas in the space between the inner and outer walls, and also prevent ingress of moisture or water vapor into the space. The outer seal 41, on the other hand, contains LNB in the event of rupture of the inner tank. Accordingly, with the structure as thus described, an effective liquid containment for the cryogenic fluid is maintained, in the event of rupture of the inner metal tank. Moreover, the unique bottom construction comprising the layers 27 of foamed glass block and the concrete slabs or layers 24 and 28 and the outer tank bottom 30 provide safety against rupture of the outer tank bottom. In other words, the toughness and resiliency of the bottom construction is such as to withstand impact loads thereon and thus a secure liquid containment is maintained, even in the event a heavy object impacts upon the bottom.

Similarly, the outer concrete wall 10 is suitably reinforced and constructed to withstand impact loads thereon, and as best seen in FIGS. 13–19, the outer concrete wall 10 is poststressed after installation, whereby the concrete wall is better able to withstand impact loads thereon and also the effects thereon of severe and rapid thermal changes in the event of an inner tank rupture are lessened.

The outer reinforced concrete wall 10 is slip-formed in 120° segments in a substantially conventional manner, and the reinforcement comprises reinforcing bars 53 and ties 54 and a double-mesh layer 55 adjacent the inner surface of the concrete wall 10. The double-mesh layer 55 at the inner surface enables the concrete wall to better withstand impact loads on the outer surface thereof. An annularly extending reinforcing cage 56 of welded together reinforcing rods is provided at the diametrically thickened upper edge portion of wall 10.

During the slip-forming operation, opposite side edges of 60° segments 57 are formed with diametrically thickened portions 58, and tubes or sleeves 59 are cast in place in the 60° arc segments, with the ends thereof exposed outwardly through recessed notches or countersunk portions 60 in the thickened portions 58. Suitable poststressing strands 61 are then passed through the sheaths or sleeves 59 and tensioned or stressed to a desired degree, and locking wedges or lugs or other suitable fastening means 62 are then secured on the ends of the strands or cables 61 and the sleeves or conduis 59 are pressure grouted with a suitable pressure grouting material 63 to thereby provide a unitary bond or lock between the sheaths 59 and strands 61 throughout their length. Thus, even in the event an impact load on the wall at the location of one of the poststressing tendons or cables should occur, the integrity of the poststressing tendon or cable remains intact throughout the rest of its arc due to the bond between the strands 61 and sheath 59 and between the sheath and the surrounding body of concrete.

During poststressing, the concrete wall moves radially inwardly, and thus the importance of the anti-friction means positioned between the footer or foundation and the bottom of the concrete wall can readily be seen.

Figure 17:
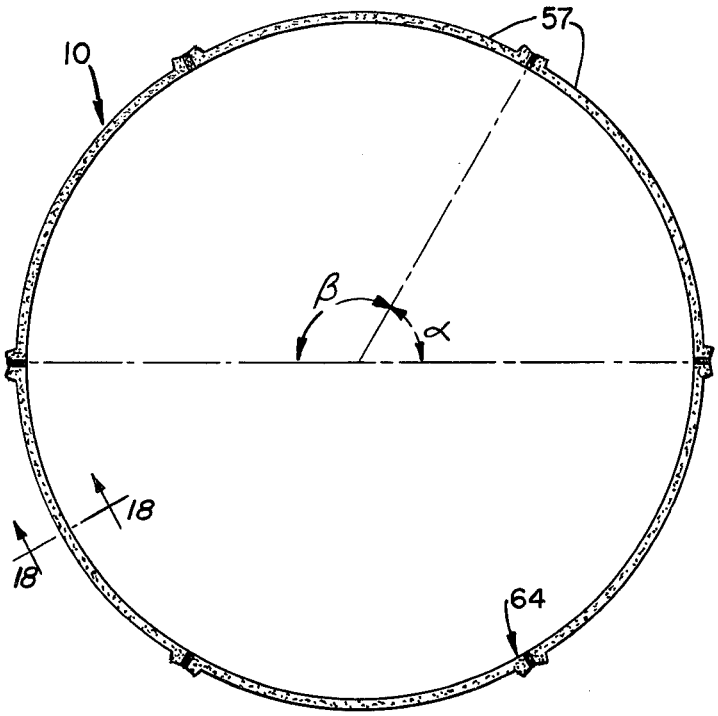
FIG. 17 is a somewhat schematic plan view of the outer concrete wall of the tank of FIG. 1, with the roof and associated structure removed, showing the arrangement of vertical seams or joints in the concrete wall.
Figure 18:
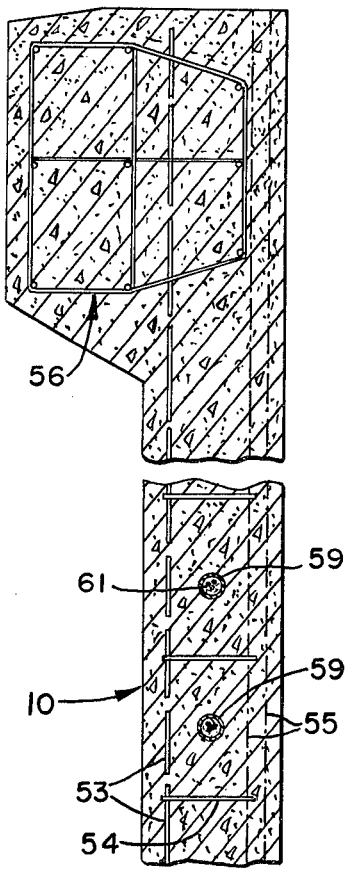
FIG. 18 is an enlarged view in section along line 18—18 of FIG. 17.
Figure 19:
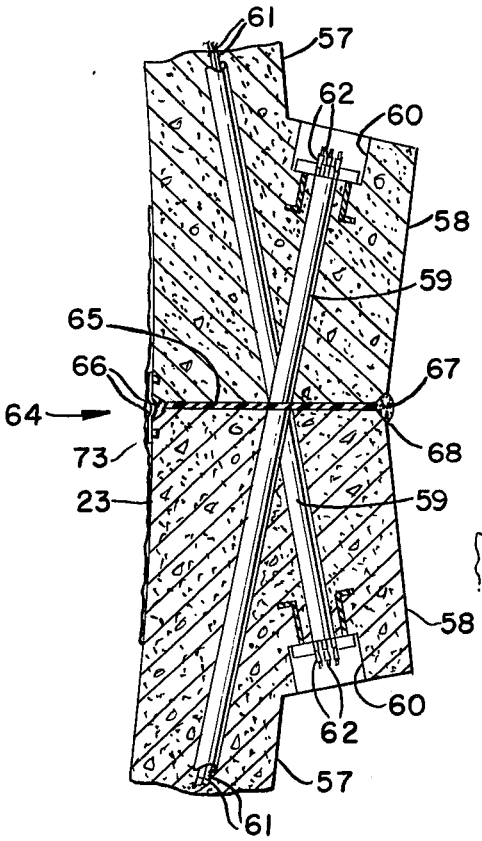
FIG. 19 is an enlarged, fragmentary, horizontal sectional view taken at one of the vertical seams in the tank wall of FIG. 17.
Figure 19A:
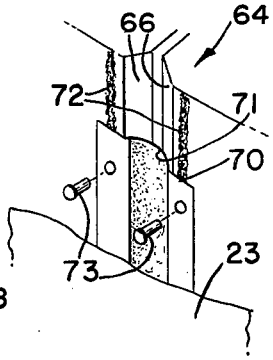
FIG. 19a is an enlarged, fragmentary perspective view of the components of the seal at the inner surface of the vertical joint between adjacent arc segments.
Figure 19A:
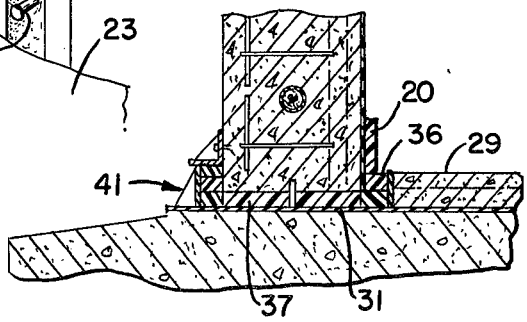

As seen in FIG. 17, the angle $\alpha$ indicates the arc subtended by one of the 60° segments 57 and the angle $\beta$ indicates a 120° arc subtended by one of the arc sections which is slip-formed during construction of the concrete wall 10. These angles are for example only, and can be different for different tank constructions.

The vertical seams or joints 64 between adjacent 60° degree arc sections 57 of the wall include a joint seal 65, at least a portion of which comprises a relatively resilient sealant material. The inner and outer edge portions 66 and 67, respectively, of the adjacent edge portions of the respective arc sections are beveled and the space 68 thus defined is filled with a suitable caulking material or compound 69. The inner joint area is suitably sealed by means of an elongate sheet 70, which may be an epoxy type plastic material reinforced with glass cloth and having a slightly concave center portion 71 at the area of the beveled edges 66 for accommodating hydrostatic loads. The sheet 70 is secured in placed by two strips of adhesive 72 extending vertically on opposite sides of the seam or joint and studs or fasteners 73 extended through opposite edge portions of the sheet into the concrete wall. The vapor barrier coating 23 is then applied over the sheet 70.

The wall-to-roof construction is seen best in FIGS. 13–16, and an annular perimeter plate 74 is supported on top of the wall and is leveled by means of a leveling grout 75 or the like placed between the perimeter plate 74 and top surface of the wall, if necessary.

An annular skirt plate 76 is fixed as by welding or the like to the inner peripheral edge of perimeter plate 74 and extends downwardly a short distance over the inner upper surface of the concrete side wall 10, and a bedding compound 77, such as caulk or the like, is placed in the space between the juncture of the bottom edge of skirt plate 76 and wall 10 and a strip of paper tape or the like 78 is then placed over the bedding compound 77 and a glass cloth reinforcement 79 is placed over the tape or the like 78 prior to application of the vapor barrier 23, which extends over and covers the seam or joint at the lower edge of the skirt plate 76.

A plurality of generally triangularly shaped plates 80 are welded at one edge to the top surface of perimeter plate 74 and at their other edge to the underside of an upwardly angularly inclined roof connecting plate 81, and a plurality of appropriately spaced rafter connectors 82 are welded in the space between the perimeter plate 74 and roof connecting plate 81. Appropriate rafters 83 are then welded or otherwise suitably affixed to the rafter connectors 82, and roof plates 84 and roof closure plate 84' are welded or otherwise suitably affixed to the rafters.

A plurality of substantially U-shaped anchors 85 are cast in the thickened concrete at the upper edge of the wall 10, with the threaded ends thereof projecting horizontally radially outwardly through the surface of the concrete wall. The anchors 85 are associated with the reinforcing cage 56 in the thickened portion of the wall. The anchors 85 are provided in closely spaced pairs in one preferred construction of the invention, and a vertically oriented, horizontal thrust yoke 86 is bolted to the exposed threaded ends of the pairs of anchors 85 and a horizontal leg 87 of the thrust yoke 86 extends inwardly over the perimeter plate 74 and over the lower edge of roof connector plate 81. The anchors 85 and horizontal thrust yokes 86 resist horizontal loads on the tank due to internal pressure.

Upstanding angle members 88 are suitably affixed to the upper outer end portions of the thrust yokes 86 for supporting a hand rail for a walkway or plateform 89 supported on top of the horizontal portion 87 of the thrust yokes 86.

The space beneath the outer peripheral edge of perimeter plate 74 and between the plate and upper surface of the concrete wall 10 is filled with a suitable construction sealant 90, such as polysulfide or the like.

A plurality of vertically extending anchor bolts 91 are pressure grouted in sleeves 92 extending through the perimeter plate 74 and into the upper portion of concrete wall 10, and nuts are applied to the upper exposed threaded ends of the anchor bolts 91 to resist vertical loads on the roof 11. An epoxy sealant 93 is applied to the threads and washer of the radially innermost anchor bolts 91, and a seal cap 94 is welded in place over the threaded end of the radially outermost anchor bolts 91. A continuous seal weld 95 is made between the inner marginal edge of perimeter plate 74 and skirt plate 76. Thus, the epoxy sealant 93 and the continuous weld 95 prevent escape of the purge gas from the tank, and the construction sealant 90 and seal cap 94 prevent the ingress of water vapor or moisture into the tank.

Figure 5:
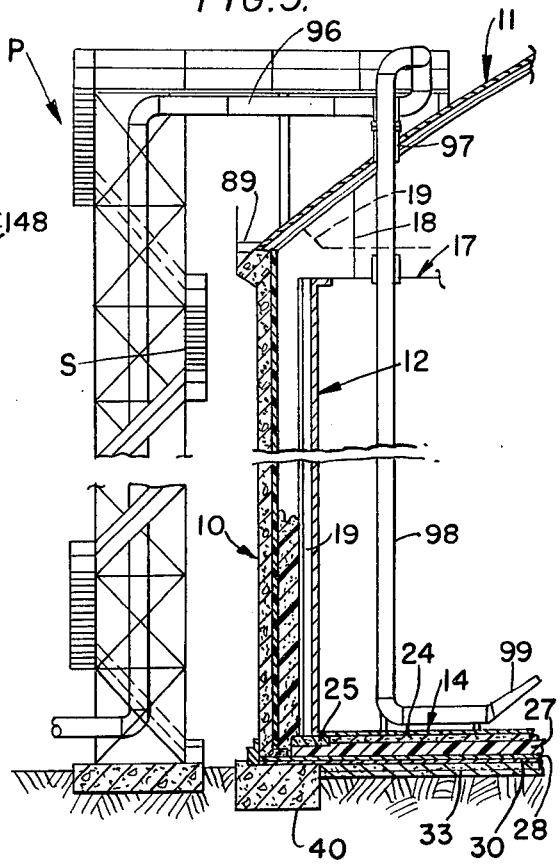
FIG. 5 is a view similar to FIG. 4, showing a bottom fill pipe in association with the tank.
Figure 4:
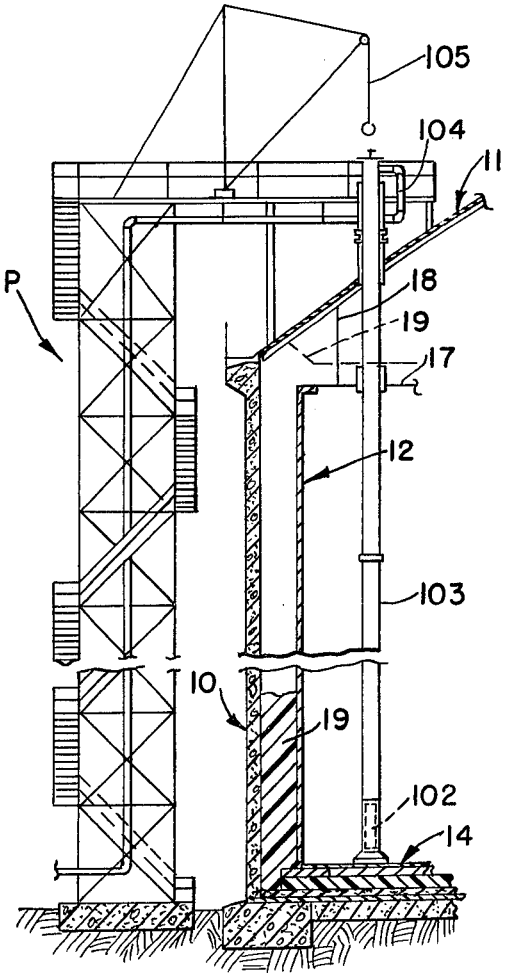
FIG. 4 is a fragmentary view in elevation of a portion of the tank of FIG. 1, showing the pipe support tower and the submerged pump for removal of liquid from the tank.
Figure 6:
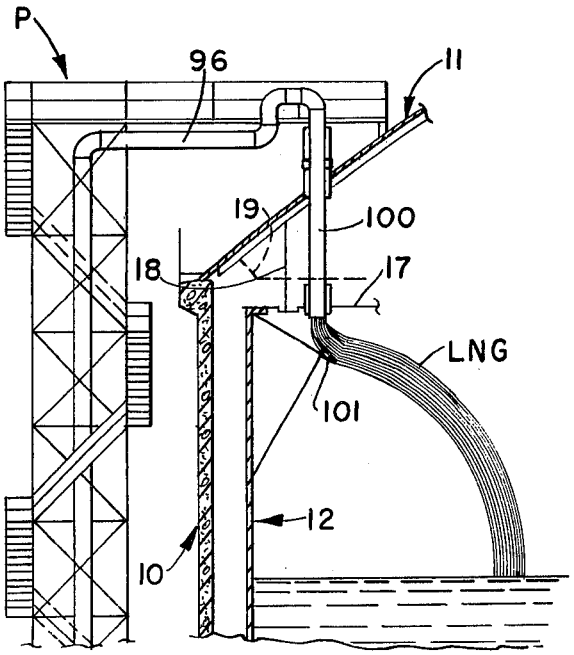
FIG. 6 is a view similar to FIG. 5 of a top fill pipe in association with the tank.

The arrangement of the fill and withdrawal pipes and the like is shown in FIGS. 4–6, and the pipe tower P includes a stair S for gaining access to the top of the tank, and as seen in FIG. 5, the supply pipe 96 for supplying liquid cryogenic fluid to the tank is supported by and extends upwardly through the tower P and thence horizontally and downwardly through a suitable fitting 97 of conventional type and through an elongate stand pipe 98 to an upwardly and inwardly inclined fill nozzle 99 at the bottom of the tank. By providing the bottom fill pipe with a nozzle as at 99, the liquid cryogenic fluid introduced through the nozzle is caused to better mix with the product in the tank, and accordingly, thermal roll-over of the product is minimized.

A top fill pipe 100 is shown in FIG. 6 connected with the supply pipe 96 on the tower P, and the top fill pipe 100 extends just through the deck 17 for discharge of the LNG onto a splash plate 101 for dispersing the LNG relatively uniformly into the tank to thus minimize rollover, as previously described.

In FIG. 4, a submerged pump arrangement 102 is shown, wherein the pump 102 is provided in the lower end of an elongate pump column 103 communicating at its upper end with a liquid discharge pipe or conduit 104 supported by and extending downwardly through the tower P to some point of use. A suitable overhead crane 105 may be provided on the tower P for removal of the pump 102 for service or the like. In this regard, the pump assembly 102 is provided with a foot valve or like structure (not shown) at the lower end of the column 103, which is held in open position when the pump 102 is lowered into its operative position, but which closes when the pump is elevated by the crane 105 for service or the like thereon. Thus, the pump column 103 is closed to the body of liquid in the tank when the pump is removed for service.

Figure 7:
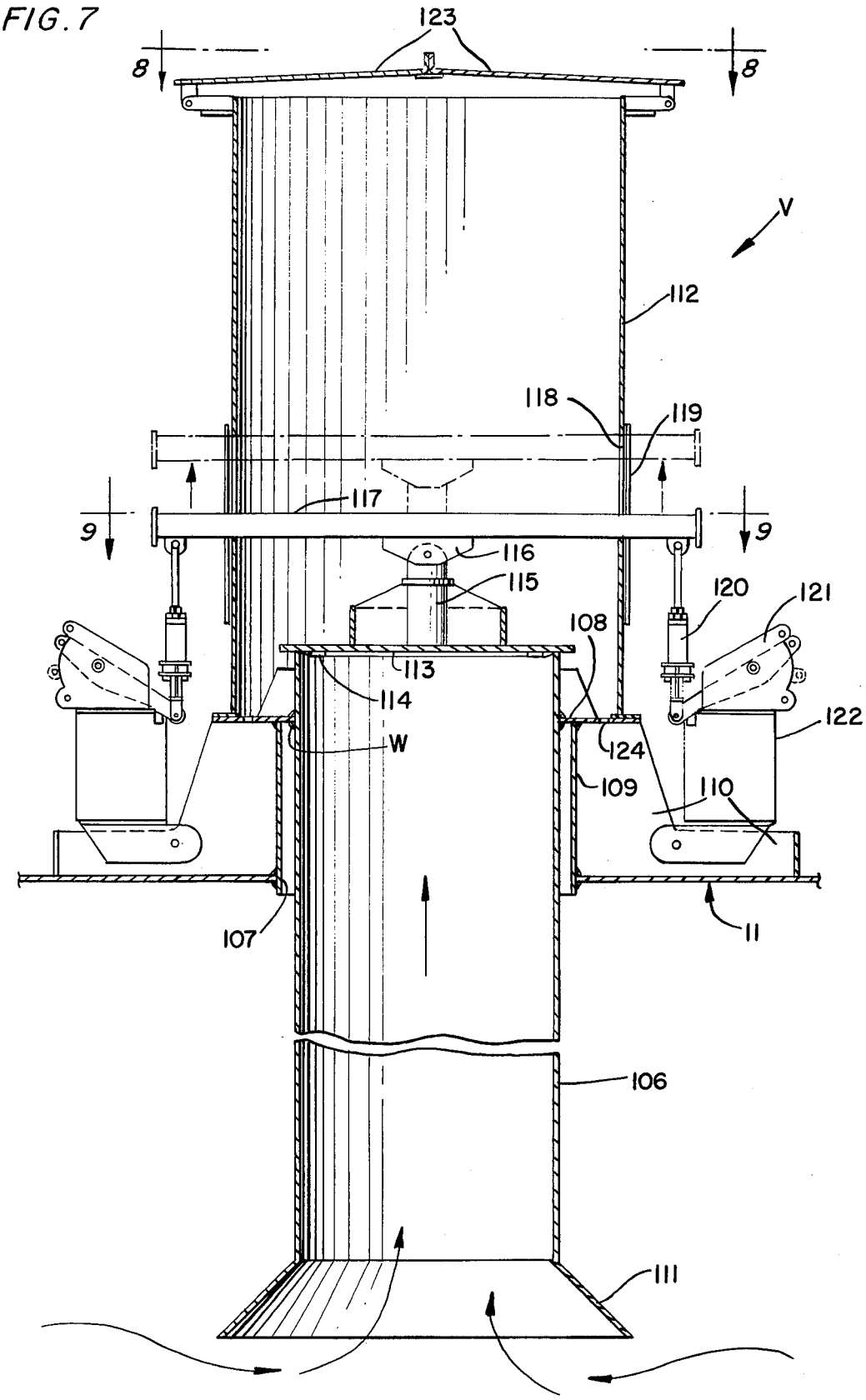
FIG. 7 is a greatly enlarged view in section of an emergency vent stack for the tank for venting vapors therefrom.
Figure 8:
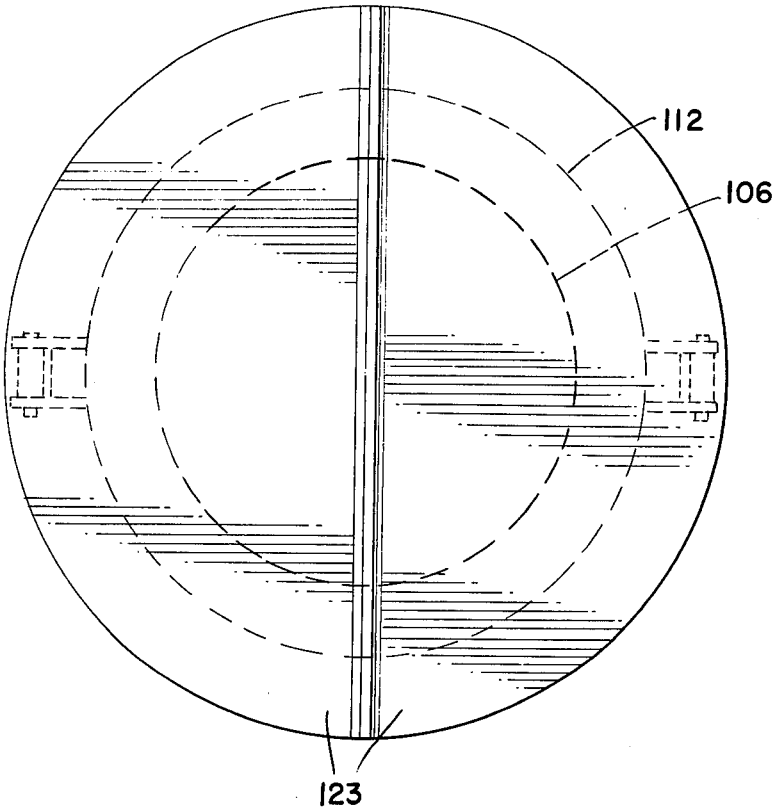
FIG. 8 is an enlarged plan view taken along line 8—8 of FIG. 7.
Figure 9:
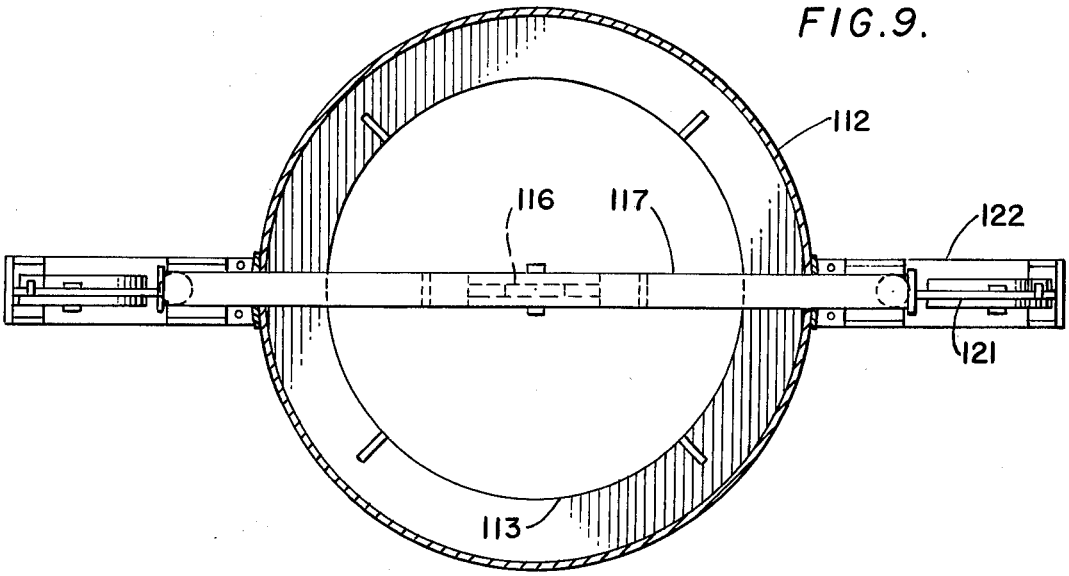
FIG. 9 is an enlarged view in section taken along line 9—9 in FIG. 7.

As seen in FIGS. 7, 8 and 9, the emergency gas vent V comprises an elongate, tubular, stainless steel nozzle 106 extending through an opening 107 in the roof 11 at the apex thereof and supported in the opening by means of a weld W or the like at the upper outer surface of nozzle 106 and welding the nozzle to an annular flange 108, which is in turn welded to an annular stainless steel thermal stop or sleeve 109 spaced radially outwardly of nozzle 106 and welded or otherwise suitably secured in the opening in roof 11. A plurality of support gussets or the like 110 are welded or otherwise suitably secured to the upper outer surface of roof 11 and to the stainless steel thermal stop 109 and flange 108 for reinforcing the vent structure. The nozzle 106 has a lower flared inlet end 111 for directing flow of gas from the tank into the nozzle. An upstanding vent stack 112 of aluminum or other suitable material is welded or otherwise suitably affixed in coaxial relationship with the nozzle 106 and extends thereabove to a distance of about 10 feet above the roof 11. A closure plate or valve 113 is seated upon the open upper end of nozzle 106 within the vent stack 112 and is sealed relative thereto by means of a suitable annular seal 114. The closure 113 is maintained in closed position by means of a biased yoke assembly, which includes an upstanding attaching bracket 115 on the closure secured to a bracket plate 116 carried between the ends of a stainless steel yoke 117, which extends outwardly at its opposite ends through slots 118 in diametrically opposite sides of the vent stack 112, and slot cover plates 119 are carried by the yoke 117 to normally cover the slots 118. The outer ends of the yoke 117 are connected through load adjusters 120 of conventional construction, with a standard pipe hanger 121 supported on top of a constant support load spring arrangement 122 of conventional construction, of the type manufactured by Grinnell, for example. Hinged weather covers 123 cover the open upper end of vent stack 112 to keep rain and the like out of the area around the closure plate 113 during use.

Under normal conditions the closure plate 113 is maintained in closed position by the constant load spring 122, and the closing bias on the plate may be adjusted through the load adjusters 120. However, in the event emergency venting of the gas pressure from the tank is required, the gas pressure overcomes the restraint imparted by the constant support load springs 122 and raises the plate 113 to its open position. The escape of gas from the nozzle 106 into the vent stack 112 blows the weather covers 123 open, permitting escape of the gas.

A drain hole 124 is provided in flange 108 for draining any moisture from the space within the vent stack 112 that may enter thereinto.

In a typical tank constructed in accordance with the invention, for example, the nozzle 106 has an inside diameter of approximately 40 inches, and the stainless steel thermal stop 109 has an inside diameter of approximately 46 inches. The nozzle 106 extends downwardly below the roof 11, and terminates above the insulation on the deck, thus leaving a layer of relatively warm gas to prevent scrubbing of the carbon steel roof during venting action. The vent stack preferably has an inside diameter of about 60 inches when used with a nozzle having the dimensions beforedescribed. A vent as described is capable of venting extremely large quantities of gas at −260° F and 2.6 psig.

Figure 20:
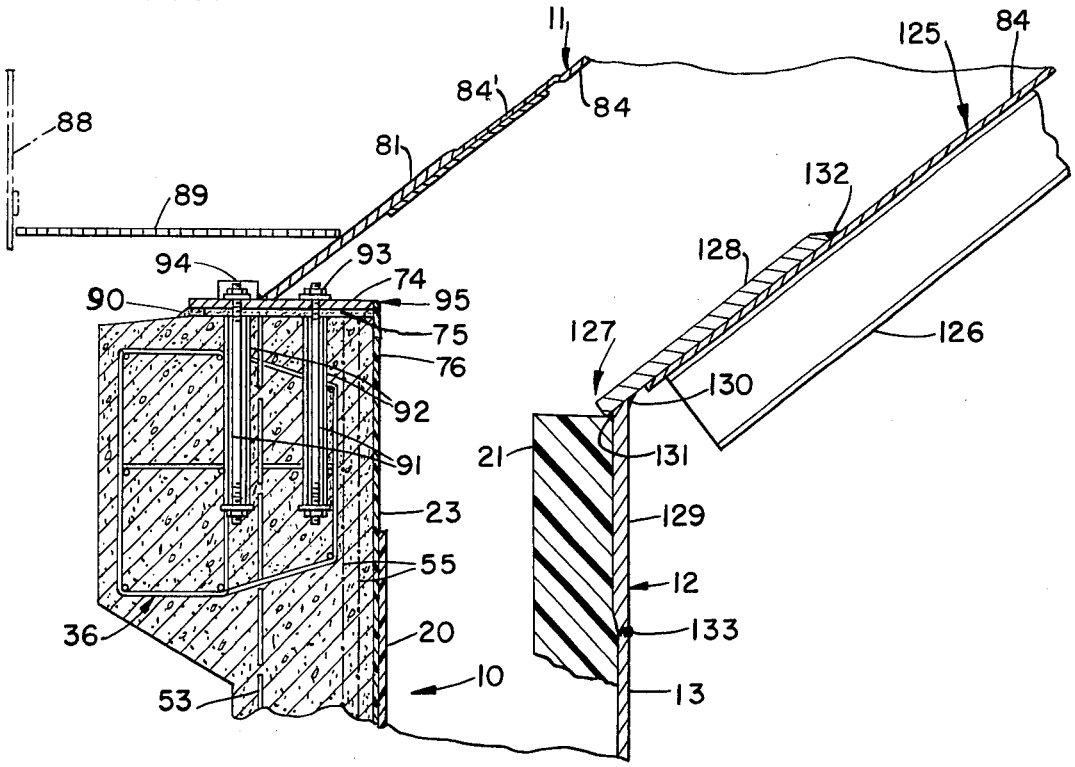
FIG. 20 is a enlarged, fragmentary, vertical sectional view of a portion of the roof and upper concrete side wall of a modified form of the invention.
Figure 21:
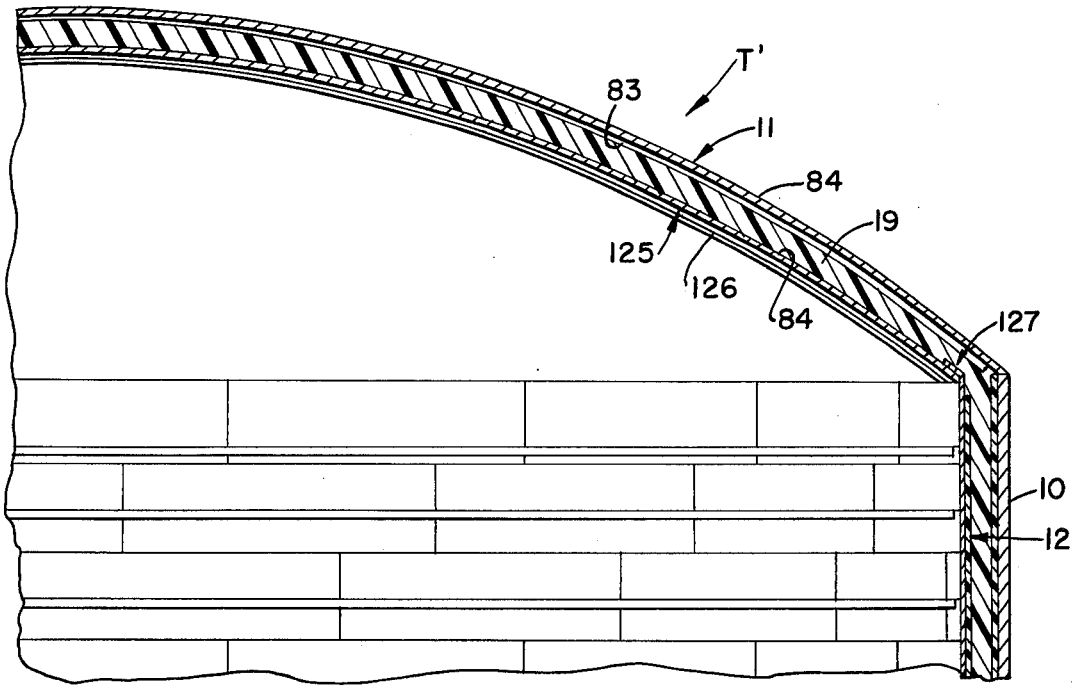
FIG. 21 is a fragmentary view in section of a portion of a tank in accordance with the second form of the invention, wherein double metal roofs are provided.

A modified tank T′ in accordance with the invention is shown in FIGS. 20 and 21, and in this form of the invention the tank is identical in all respects with that form previously described, except that rather than having a suspended insulation deck, it will have an inner metal roof 125 supported on the inner metal tank wall 12. The inner metal roof 125 comprises metal plates 84 supported on a roof girder 126 and the roof 125 and inner wall 12 are interconnected via a rim girder 127. The rim girder comprises a cone plate 128 and a cylinder plate 129 which are welded together in inner and outer structural welds and seals 130 and 131, respectively. The cone plate in turn is welded to the roof by a weld 132 and the cylinder plate is welded to the plates 13 of the wall by a weld 133.

A second modified tank in accordance with the invention is indicated generally at T″ in FIGS. 24–28, and in this form of the invention the tank comprises both an inner steel wall 13, as previously described, having a blanket of glass fiber 20 applied to the outer surface thereof, and a reinforced and insulated bottom 22 substantially as previously described. The inner tank also includes a suspended insulation deck 17 held in place by means of hangers 18, as previously described, and an outer steel tank wall 134 is supported on the ring wall foundation or footer 40 and has a glass fiber blanket 21 applied thereto. The space between the inner and outer steel tank walls 12 and 134 is filled with a suitable insulation 19, such as perlite or the like, as previously described, and the insulation also extends over the insulation deck 17, as previously described. The glass fiber blankets 20 and 21 control compaction of the perlite insulation, as previously described, and as set forth in U.S. Pat. No. 3,481,504. The concrete protective wall 10′ is sealed relative to the footer by means of a seal 41 substantially as previously described with regard to the embodiment of the invention illustrated in FIG. 1. The upper edge of the protective wall 10′ extends upwardly beyond the upper edge of the outer steel wall 134, whereby the line of sight over the wall is above the roof or outer steel dome 11 supported on the outer steel wall 134 when the tank is viewed from the ground. A gutter 135 is provided adjacent the lower peripheral edge portion of roof 11, and a sump pump 136 is provided at the bottom of the annular space between the concrete wall 10′ and the outer steel wall 134 for removing any rain water and the like collected therein.

The concrete wall 10′ is approximately 18 inches thick, and includes the double mesh reinforcement 55 adjacent the inner surface thereof, as previously described, as well as the reinforcing and poststressing tendons, as previously described. Also the vertical seams or joints between adjacent arc segments 57 are substantially the same as previously described, with the exception of a vapor barrier 23 on the inner surface.

Further, in this form of the invention, only the first course of plates in the outer steel wall 134 are made of 9% nickel steel, and the remaining plates comprise carbon steel. Moreover, in this form of the invention, as well as in the forms previously described, the plate thicknesses vary from the bottom to the top courses thereof, and the thicknesses range from 1.005 to 0.375 inch.

Figure 22:
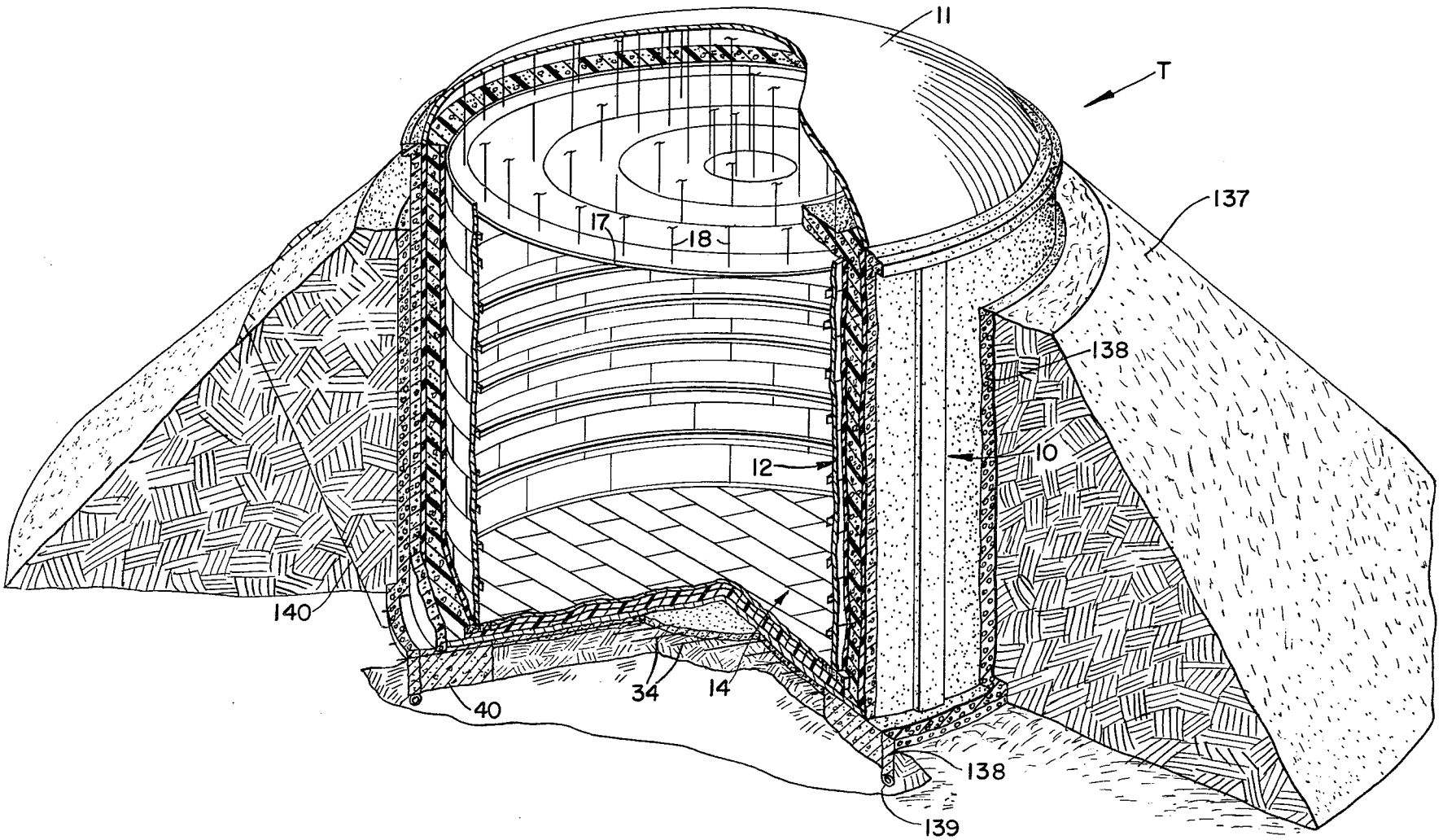
FIG. 22 is an enlarged, perspective view, with portions broken away and shown in section, of a third form of the invention, wherein earth and the like is backfille against the tank upon its completion.

In FIG. 22 a tank T substantially of the same form as described and illustrated in FIG. 1 is shown surrounded with a backfilled earth berm 137 therearound. A suitable granular material 138, such as gravel or the like, is disposed around the concrete wall 10 of the tank T between the tank and berm 137 for drainage of water, and suitable drain pipe means or the like 139 is provided around the bottom of the footer 40 for draining the water away. The heater conduits 34 are connected through upwardly extending portions 140 with a suitable supply cable on the side of the berm 137. Thus, in this form of the invention the berm 137 provides extra protection against impacts on the side wall of the tank.

Figure 23:
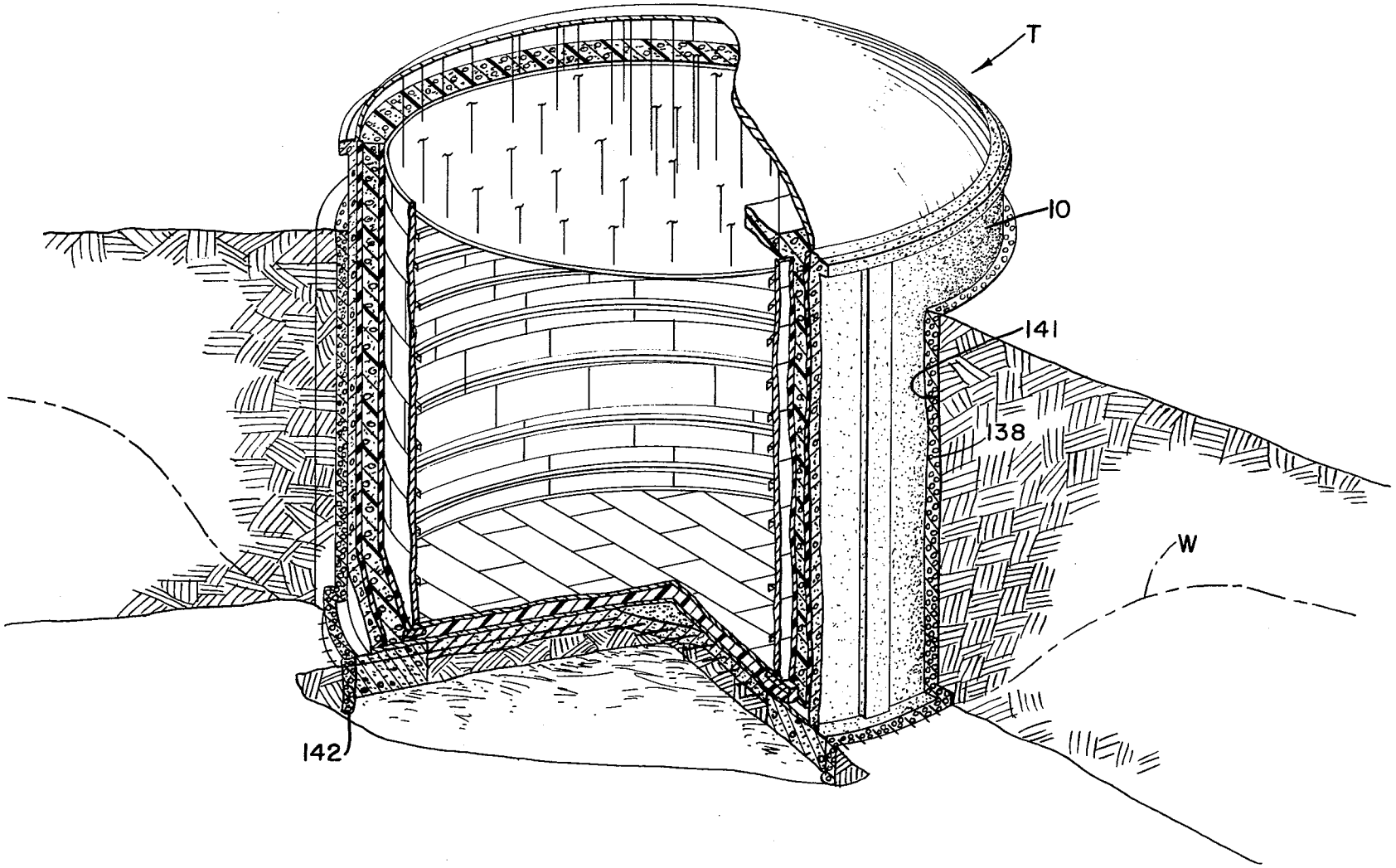
FIG. 23 is a view similar to FIG. 22 of a fourth form of the invention, wherein the tank is recessed in the ground.
Figure 25:
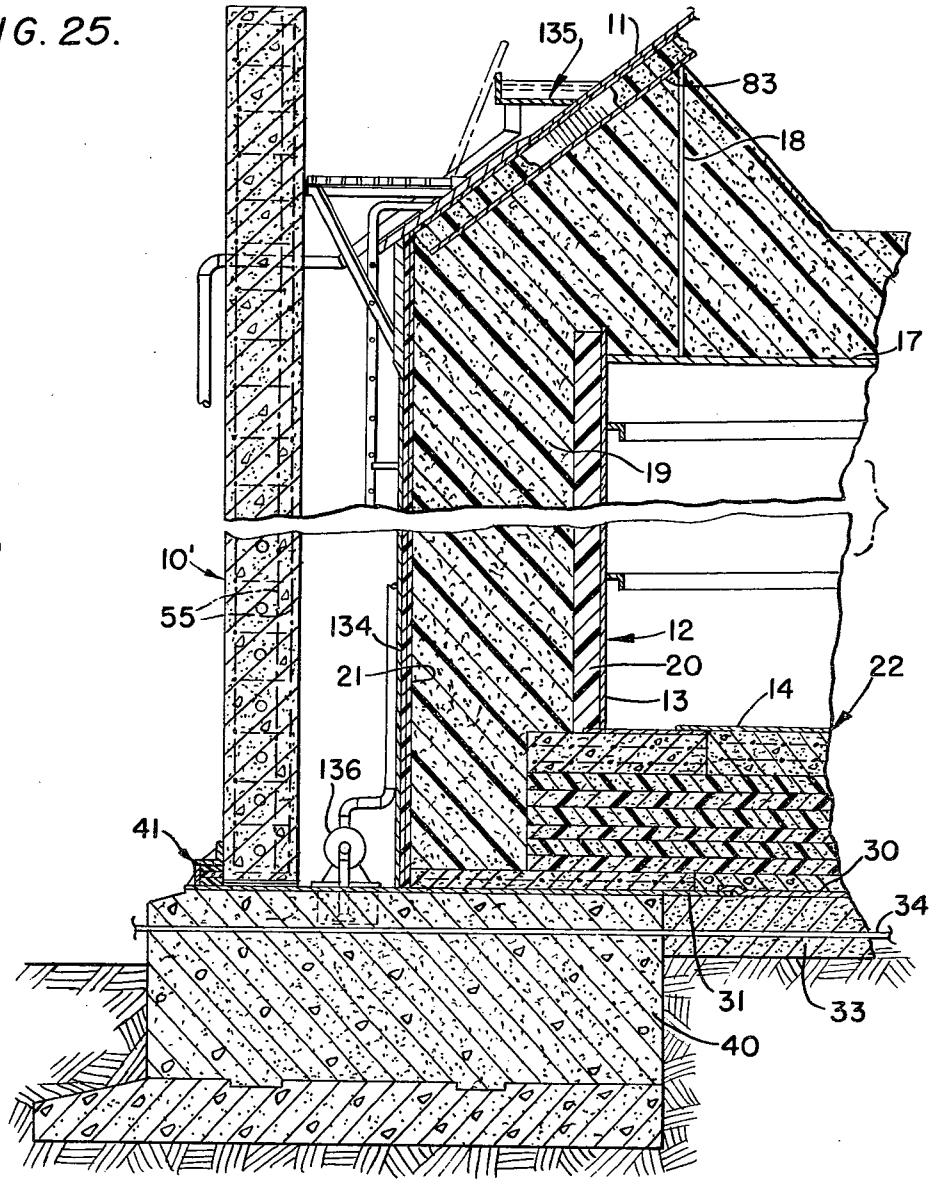
FIG. 25 is a greatly enlarged fragmentary view in section, with portions broken away, of a portion of the top, bottom and side walls of the tank of FIG. 24.
Figure 24:
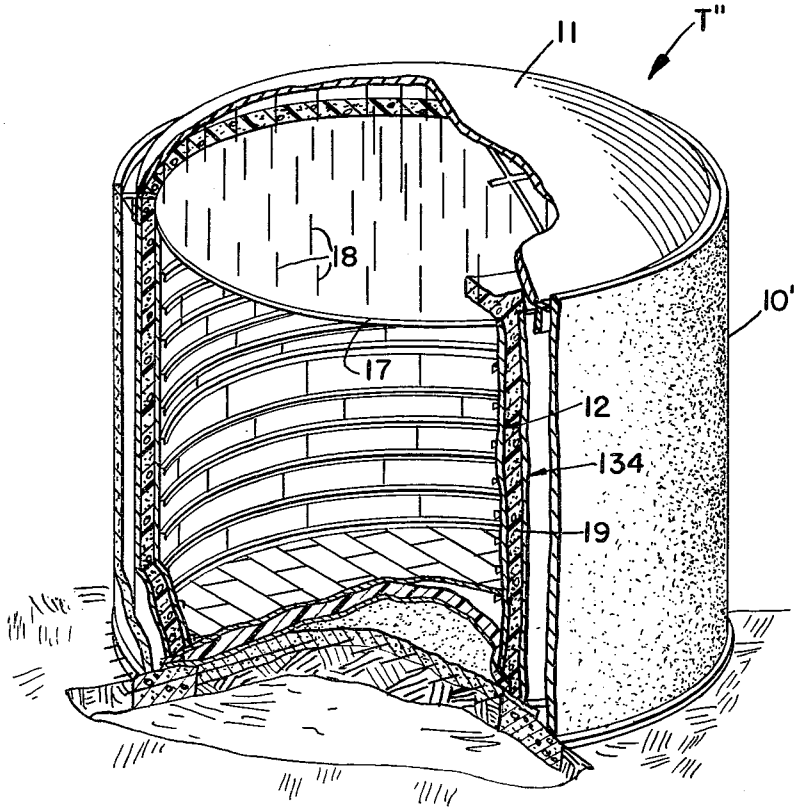
FIG. 24 is a perspective view, with portions broken away and shown in section, of a fifth form of the invention, wherein the tank comprises inner and outer steel walls with a spaced concentric concrete wall for protection against impact forces.
Figure 26:
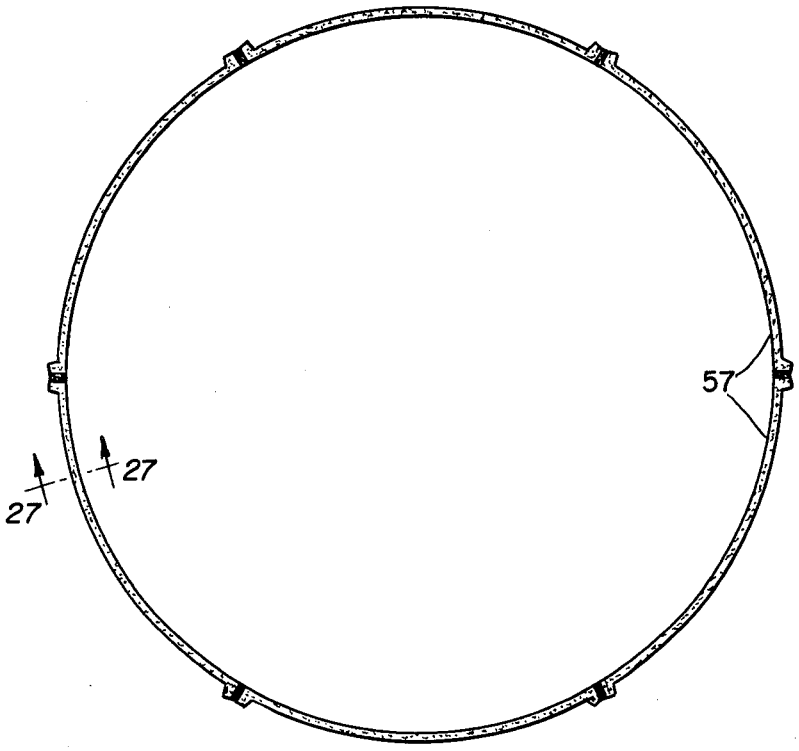
FIG. 26 is a view similar to FIG. 17 of the concrete wall of the form of the invention in FIGS. 24 and 25.
Figure 27:
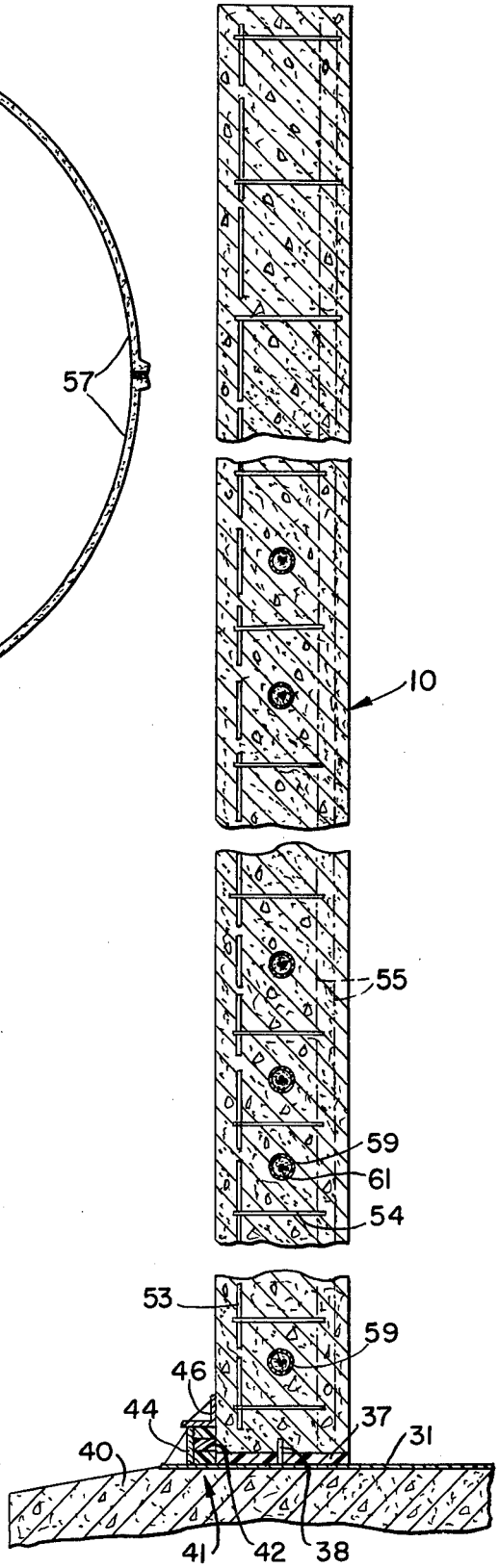
FIG. 27 is an enlarged, vertical view in section taken along line 27—27 of FIG. 26.
Figure 28:
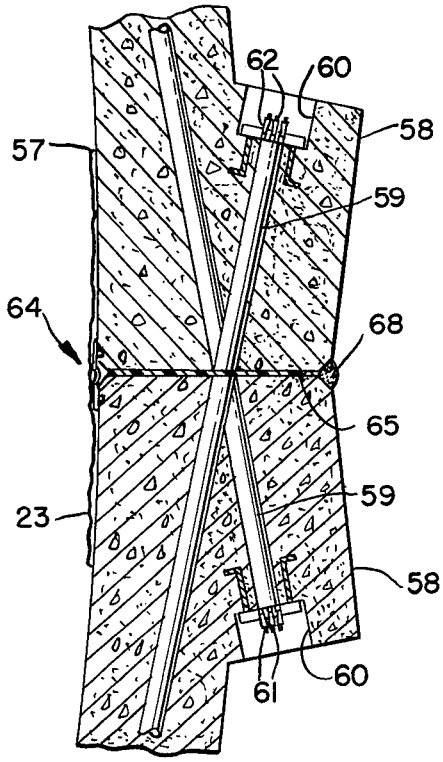
FIG. 28 is an enlarged view in section similar to FIG. 19 of one of the vertical joints or seams in the wall of FIG. 26.

Similarly, in FIG. 23 a tank T in accordance with the invention is shown recessed into a cavity 141 in the ground, and a suitable granular material, such as gravel or the like 138, fills an annular space between the outer surface of the side wall 10 of the tank and the surface of the hole 141 for drainage of liquid. Suitable drain means, including pump means, if desired, are provided at 142 for removing water from adjacent the tank to maintain the water table depressed, as indicated at W.

Figure 3:
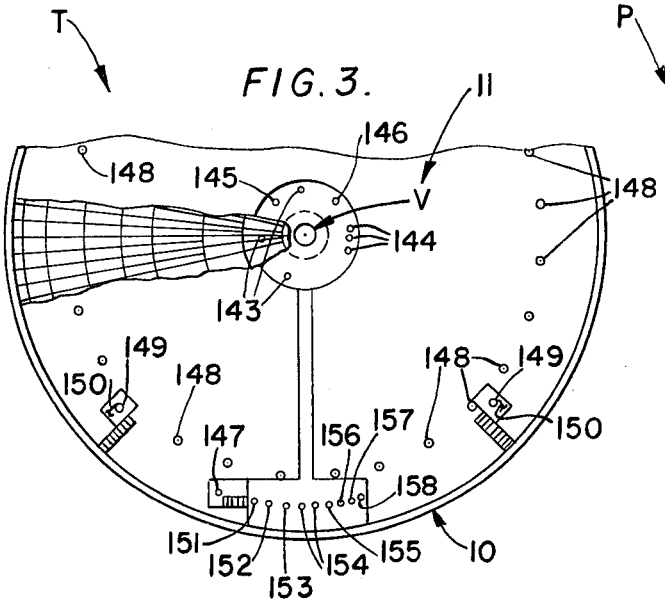
FIG. 3 is a fragmentary, plan view of the tank of FIG. 1, showing the arrangement of ports and the like therein for liquid control into and out of the tank.

Referring now to FIG. 3, the various roof access openings and arrangement of pipes and control devices and the like is seen, and at the center of the roof 11 of the tank a plurality of vacuum relief valves or ports 143 are provided in association with a pressure relief manifold 144 and a deck vent 145. A roof manway 146 is also provided adjacent the center of the roof, and a roof manway 147 is provided near the periphery of the roof at the point where the liquid fill and withdrawal fittings are provided. A plurality of substantially uniformly spaced perlite fill ports 148 are spaced around the tank adjacent the periphery of the roof, and in one embodiment, approximately 28 such ports are provided. Spaced apart approximately 90° are a pair of liquid level float gauges 149 and vapor phase pressure taps 150.

The pipes supported by the tower P include a cool-down line 151, a bottom fill line 152, a vapor withdrawal line 153, a pair of pump column liquid withdrawal lines 154, a top fill line 155, a pressurization gas supply line 156, an LNG temperature sensing port 157, and a purge gas port means 158.

A tank in accordance with the invention may be used for either peak shaving service or, in other words, it will be filled and/or emptied only once or twice a year, or it may be used for base load service, in which the tank will be in continuous use with LNG being added to and removed from the tank on a regular basis.

Moreover, although particular materials, and in some cases dimensions, have been described herein for the tank according to the invention, it is to be understood that other materials and dimensions may be used, dependent upon the type of service required. With regard to the foundation, the preferred construction comprises reinforced concrete, as described herein, but rather than the ring wall construction described, a pilecap or other suitable foundation construction may be used, depending on local soil conditions.

In accordance with the present invention, the principal design considerations are that an inner tank and an outer tank be provided, each capable of containing LNG, and the outer tank wall, or in the case of FIGS. 24–28, an outer protective wall, is designed to withstand local impact forces thereon. In either event, the outermost wall is capable of containing LNG. Accordingly, the outer reinforced concrete tank, as in FIG. 1, or the outer protective wall, as in FIG. 24, serve to protect the inner steel tank walls or wall from damage due to local impact forces thereon, and accordingly, the integrity of the LNG containment or confinement is maintained. Additionally, in the forms of the invention illustrated in FIGS. 1–23, the outer reinforced concrete wall has means associated therewith for preventing either the ingress or egress of vapor therethrough. Thus, not only is water vapor prevented from entering from the surrounding atmosphere into the insulation space, but purge gas in the insulation space is also prevented from escaping to atmosphere. Further, the unique bottom construction of the tank is such that the LNG is contained even in the event of an impact force on the bottom of the tank, as for example, by an object dropped through the roof thereof.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. An impact resistant tank for storing cryogenic fluids, comprising: an inner tank of metallic material compatible with cryogenic temperatures and having a side wall, a bottom and a roof means; insulation means surrounding the side wall and positioned below the bottom and above the roof means for insulating the inner tank from ambient temperature; an impact resisting, free standing, reinforced concrete wall positioned in concentric, spaced relationship around said inner tank, said concrete wall extending at its upper end above the upper end of the inner tank side wall, said concrete wall being post-tensioned to increase the ability of the concrete to withstand cryogenic temperatures; an impact resisting, reinforced concrete bottom disposed in underlying relation to the inner tank bottom, said concrete wall protecting the inner tank wall from impact loads to maintain the liquid-containing integrity thereof, and said concrete bottom increasing the resistance of the inner tank bottom to impact loads thereon; and seal means on the inner surface and at the bottom edge of the reinforced concrete wall for containing cryogenic liquid in the event of a leak or rupture in the inner tank.

2. A tank as in claim 1, wherein an outer metal bottom is positioned in spaced relationship below the inner tank bottom, with insulation means sandwiched therebetween, the impact resisting concrete bottom being between the inner and outer tank bottoms, whereby the tank bottom is enabled to withstand impact loads thereon without destroying the liquid containment capability of the outer metal bottom.

3. A tank as in claim 2, wherein the impact resisting reinforced concrete wall comprises the wall of an outer tank surrounding the inner tank, a roof supported on the concrete wall and extending in covering relationship to the inner tank, a suspended insulation supporting deck operatively supported at the upper end of the inner tank, and insulation filling the annular space between the inner tank and outer concrete tank wall and extending across the suspended deck at the upper end of the inner tank.

4. A tank as in claim 3, wherein an insulation compaction control arrangement is provided in the annular space between the inner steel tank and the outer concrete tank, said compaction control arrangement comprising a layer of glass fiber on the outer surface of the steel tank side wall and a layer of glass fiber on the inner surface of the surrounding concrete wall, said layers of glass fiber being compressible to prevent damage to the inner steel tank upon compaction of the insulation filling the annular space between the steel wall and concrete wall, and a vapor impervious coating on the inner surface of the concrete wall to prevent movement of gas vapor and water vapor therethrough.

5. A tank as in claim 3, wherein the insulated bottom comprises a slab of wire mesh reinforced concrete beneath the inner steel tank bottom, a relatively thick layer of shock absorbing insulating material beneath the slab of concrete, a second slab of lean concrete beneath the layer of shock absorbing material, said outer steel tank bottom positioned beneath the second layer of concrete, and a layer of sand beneath the outer tank steel bottom.

6. A tank as in claim 5, wherein heater means extends in the layer of sand for maintaining the ground temperature beneath the tank above a predetermined minimum temperature.

7. A tank as in claim 6, wherein the first and second slabs of concrete, the inner tank steel bottom and the layer of shock absorbing insulating material extend outwardly beneath the inner tank steel side wall, and said outer tank steel bottom extends outwardly beneath the concrete wall.

8. A tank as in claim 7, wherein both the inner tank steel wall and the outer concrete wall are supported on a ring wall foundation of reinforced concrete, an annular layer of wire mesh reinforced concrete is disposed beneath an outer peripheral edge portion of the layer of shock absorbing insulating material, and said annular layer of reinforced concrete extends outwardly to a point spaced radially inwardly of the inner surface of said concrete wall, and an elastomeric sealant disposed in the space between said annular layer of concrete and the inner surface of the outer concrete wall.

9. A tank as in claim 8, wherein a liquid-tight seal is provided between the lower outer edge portion of said concrete wall and the outer upper peripheral surface portion of said outer steel tank bottom wall for containing LNG.

10. A tank as in claim 9, wherein a plurality of layers of sheet gasket material are positioned between the bottom of said concrete wall and the top surface of said outer steel tank bottom.

11. A tank as in claim 3, wherein an annular roof perimeter plate is secured on top of said concrete wall, a plurality of rafter connectors affixed to the top of said perimeter plate, and a plurality of upwardly inclined rafters affixed to said rafter connectors, said roof comprising a plurality of steel plates affixed to said rafters.

12. A tank as in claim 11, wherein a reinforcing cage of steel rods is cast in the concrete adjacent the upper edge thereof and the upper edge portion of said concrete wall is radially thickened, a plurality of U-shaped anchors embedded in said concrete and having threaded ends projecting radially outwardly through the surface thereof, and horizontal thrust yoke means including a vertical leg secured to said anchors and projecting upwardly therefrom and having a horizontal leg affixed thereto and extending inwardly over said perimeter plate and secured to said perimeter plate and to a peripheral edge of said roof.

13. A tank as in claim 12, wherein an annular, ring-shaped skirt plate is welded to the inner marginal edge of said perimeter plate and extends downwardly over an upper inner surface portion of the concrete wall, said vapor barrier extending upwardly over a lower edge portion of said skirt plate to effect a vapor-proof seal therewith.

14. A tank as in claim 13, wherein a plurality of anchor bolts are cast in the upper edge portion of said concrete wall, and extend upwardly through the perimeter plate and fastener means engaged on the anchor bolts to anchor the perimeter plate securely in position and hold the roof downwardly against internal vapor pressure.

15. A tank as in claim 14, wherein said anchor bolts include an inner anchor bolt with its upper end positioned beneath said roof and an outer anchor bolt with its upper end positioned outwardly of said roof, and epoxy sealant applied to the anchor bolt thread of the inner anchor bolt to effect a vapor-tight seal thereat, and thus seal gas in the tank, and a seal cap welded over the exposed upper end of the outer anchor bolt to effect a seal thereat and thus prevent flow of moisture from the atmosphere into the tank.

16. A tank as in claim 2, wherein insulation fills the annular space between the inner tank and the concrete wall, and a vapor barrier on the inner surface of the concrete wall to minimize ingress of moisture and water vapor into the insulation space between the inner tank wall and the concrete wall and to minimize egress of gas vapor through the concrete wall to atmosphere.

17. A tank as in claim 2, wherein the outer metal tank bottom extends outwardly beneath the concrete wall and a layer of antifriction material is provided between the outer tank bottom and the bottom edge of the concrete wall to enable relative movement therebetween upon thermal expansion and contraction of the tank components.

18. A tank as in claim 2, wherein the concrete wall is slip-formed in first predetermined arc segments and is poststressed in second predetermined arc segments.

19. A tank as in claim 18, wherein the first predetermined arc segments extend over 60°, and vertically extending seams are formed in the concrete wall at the opposite edges of the 60° arc segments, said vertical seams having seal means associated therewith for minimizing movement of moisture vapor therethrough and for enabling flexing action of the arc segments relative to each other about said vertical seams.

20. A tank as in claim 3, wherein the layer of insulating material in the tank bottom comprises a plurality of layers of foamed glass coated with asphalt.

21. A tank as in claim 3, wherein a purge gas is provided in the insulation space between the inner tank wall and the outer tank wall.

22. A tank as in claim 2, wherein the roof comprises a composite concrete-steel roof and includes an inner steel roof with a cast in place reinforced concrete outer roof, and a plurality of shear connectors affixed to the steel roof and embedded in the concrete.

23. A tank as in claim 22, wherein an inner steel roof is supported on the side wall of the inner steel tank in spaced relationship to the outer composite steel and concrete roof, said outer steel and concrete roof being supported on the concrete wall.

24. A tank as in claim 23, wherein insulation fills the space between the inner and outer tank walls and the inner and outer tank roofs.

25. A tank as in claim 24, wherein the upper edge of the concrete wall comprises an upwardly and inwardly facing inclined surface, a steel cap plate affixed to said surface and anchored thereat by means of a plurality of anchors embedded in the concrete and extending through the cap plates and having fasteners engaged thereon, said composite concrete and steel roof supported on said inclined surface and extending upwardly therefrom.

26. A tank as in claim 2, wherein concentric radially spaced apart inner and outer steel tank walls are supported on the bottom, and the bottom comprises an inner tank steel bottom extending beneath the inner tank steel wall and an outer tank steel bottom extending outwardly beneath the concrete wall, said concrete wall being spaced outwardly from the outer tank steel wall and extending above the upper edge of the outer tank steel wall to protect the same against impact loads thereon.

27. A tank as in claim 26, wherein a steel roof is supported on top of the outer tank steel wall and insulation is provided in the space between the inner and outer tank steel walls and across the top of the inner steel tank.

28. A tank as in claim 27, wherein the tank bottom includes a layer of shock absorbing insulating material between the inner and outer steel tank bottoms for enabling the tank bottom to absorb impact loads thereon as from an object falling through the roof of the tank, whereby to maintain the integrity of the liquid containment of the outer tank steel bottom.

29. A tank as in claim 2, wherein a bottom fill nozzle extends into the inner tank to adjacent the bottom thereof and points upwardly and radially inwardly to disperse LNG into the tank in a manner to avoid excessive localized cooldown of the tank during a filling operation.

30. A tank as in claim 2, wherein a top fill pipe extends through the roof of the tank to a point closely adjacent the upper end of the inner tank side wall for introducing LNG into the tank, and a splash plate positioned for impingement of LNG thereon as it flows from the top fill pipe to thus avoid excessive localized cooldown of the tank during filling thereof.

31. A tank as in claim 2, wherein an LNG withdrawal pump is provided at the lower end of a pump column extending downwardly into the inner tank, said pump being removable from said pump column for service and the like, and valve means at the lower end of the pump column which is opened upon operative placement of the pump in the pump column and which is closed upon removal of the pump to thereby prevent loss of LNG through the pump column when the pump is removed therefrom.

32. A tank as in claim 1, wherein a double layer of mesh reinforcement is cast in the concrete wall adjacent the inner surface thereof to aid in enabling the concrete wall to withstand external impact loads thereon.

33. A tank as in claim 32, wherein the concrete wall is poststressed to enable it to better withstand external impact loads thereon and also to enable it to withstand thermal shock resulting from a leak of LNG stored in the tank.

34. A tank as in claim 1, wherein an emergency vent is in the roof of the tank for venting gas from the interior of the tank.

35. A tank as in claim 34, wherein the vent comprises: a nozzle affixed to the roof of the tank and extending downwardly into the tank a predetermined distance below the inner surface of the roof to thereby leave a layer of relatively warmer gas adjacent the roof to prevent scrubbing of the roof by the gas as the gas is vented from the tank.

36. A vent as in claim 35, wherein the nozzle includes a flared inlet end within the tank and an open outlet end exteriorly of the tank, and a closure plate normally sealed on the outlet end of the nozzle and maintained in closed position by means of a constant load spring means connected with the closure.

37. A vent as in claim 36, wherein a weather cover is provided over the outlet end of the nozzle exteriorly of the tank.

38. A tank as in claim 1, wherein the concrete wall comprises a plurality of adjacent 60° arc segments having vertical seams at the opposite edges thereof, seal means in the seams enabling flexing movement of the vertical seams or joints between adjacent arc segments, and liquid containing seal means on the inner surface of the concrete wall extending longitudinally of the vertical seams, said liquid containing seal means comprising a glass fiber cloth reinforced plastic sheet adhesively secured to the inner surface of the concrete wall at opposite side edges thereof on opposite sides, respectively, of the seam between adjacent arc segments, and mechanical fasteners extended through opposite edge portions of the sheet into the concrete wall, and a vapor impervious coating applied over the sheet and fasteners and over the inner surface of the concrete wall.

39. A tank as in claim 1, wherein the tank is recessed into the ground with only a top portion of the side wall thereof projecting above the ground.

40. A tank as in claim 1, wherein a backfilled earth berm is piled around said tank to a point closely adjacent the upper edge of the tank side wall.

41. A tank as in claim 1, wherein the height of the concrete wall is such that the line of sight over the concrete wall when standing on the ground is above the roof of the tank.

42. A tank as in claim 1, wherein a liquid containing dike is provided in spaced relation outwardly of said tank for containing LNG leaked from the tank in the event of a rupture thereof.

* * * * *